US005873352A

United States Patent [19]

Kidokoro et al.

[11] Patent Number: 5,873,352

[45] Date of Patent: Feb. 23, 1999

[54] FAILURE DIAGNOSING APPARATUS FOR AN EVAPOPURGE SYSTEM

[75] Inventors: Toru Kidokoro, Hadano; Takaaki Ito, Mishima, both of Japan

[73] Assignee: Toyota Jidosha Kabushiki Kaisha, Toyota, Japan

[21] Appl. No.: 935,010

[22] Filed: Sep. 22, 1997

[30] Foreign Application Priority Data

Sep. 24, 1996 [JP] Japan ..... 8-251949

[51] Int. Cl.[6] ..... F02M 37/04

[52] U.S. Cl. ..... 123/520

[58] Field of Search ..... 123/516, 518, 123/519, 520, 198 D

[56] References Cited

U.S. PATENT DOCUMENTS

| | | | |
|---|---|---|---|
| 5,425,344 | 6/1995 | Otsuka et al. | 123/520 |
| 5,443,051 | 8/1995 | Otsuka | 123/520 |
| 5,462,034 | 10/1995 | Kadota | 123/520 |
| 5,479,905 | 1/1996 | Ito | 123/520 |
| 5,765,540 | 6/1998 | Ishii et al. | 123/520 |
| 5,775,307 | 7/1998 | Isobe et al. | 123/520 |

FOREIGN PATENT DOCUMENTS

| | | |
|---|---|---|
| 4-325760 | 11/1992 | Japan . |
| 5-125997 | 5/1993 | Japan . |
| 6-147032 | 5/1994 | Japan . |
| 7-317612 | 12/1995 | Japan . |

*Primary Examiner*—Thomas N. Moulis
*Attorney, Agent, or Firm*—Kenyon & Kenyon

[57] ABSTRACT

A failure diagnosing apparatus makes an judgment as to whether or not a failure occurs in an evaporated fuel processing apparatus in which an evaporated fuel within a fuel reservoir is adsorbed by an activated charcoal within a canister and the evaporated fuel adsorbed by the activated charcoal is purged to an intake system of an internal combustion engine under a certain operational condition. An atmospheric air is introduced into the fuel reservoir when the fuel is supplied to the fuel reservoir. Accordingly, there is a fear that a misdiagnosis is performed if the failure diagnosis is performed during fuel supply. Accordingly, when the internal combustion engine is in operation and in fuel supply condition, the failure judgement process by the failure diagnosing apparatus is forbidden.

8 Claims, 15 Drawing Sheets

RESERVOIR INTERNAL PRESSURE BEHAVIOR(EXAMPLE IN WHICH THE NORMALITY JUOGEMENT HAS BEEN MADE AT Pmax)

FAILURE DIAGNOSING APPARATUS FOR AN EVAPOPURGE SYSTEM

BACKGROUND OF THE INVENTION

The present invention relates to an apparatus for diagnosing a failure or breakdown of an evapopurging system for adsorbing evaporated fuel (vapor) of an internal combustion engine to an adsorbent within a canister and purging the adsorbed fuel to an intake system of the internal combustion engine under a predetermined operation condition for combustion.

For the purpose of preventing the fuel (vapor), that has been evaporated within a fuel reservoir, from being discharged to the atmosphere, there are some internal combustion engine provided with an evapopurge system for once adsorbing the vapor in a canister and sucking the adsorbed fuel to an intake passage during the travel of the vehicle to thereby burn the fuel.

In such internal combustion engines provided with the evapopurge system, since the purge passage from the fuel reservoir through the canister to the intake passage would be damaged due to some causes, or the vapor would be discharged to the atmosphere in case of the separation of the piping system, in order to avoid such defects, it is necessary to diagnose whether there is any breakdown of the evapopurge system or not. To meet this requirement, in general, the internal combustion engines having the evapopurge system is provided with a failure diagnosing apparatus.

A conventional failure diagnosing apparatus for an evapopurge system is disclosed in, for example, Japanese Patent Application Laid-Open No. Hei 5-125997. The principle of many conventional failure diagnosing systems is that, after the interior of the vapor passage is kept under the negative pressure condition, the vapor passage connecting the canister and the intake passage to each other is interrupted to define the fuel reservoir, the canister and the vapor passage into a single closed space, and the presence/absence of the failure is diagnosed by a pressure change in the closed space.

In other words, the pressure in the above-described closed space changes when time lapses, however, in the case where there is no failure or breakdown in the vapor passage, the pressure change rate is low to thereby keep the negative pressure condition. In contrast, in the case where there is any failure or breakdown in the vapor passage, the pressure change rate is high and in addition, the internal pressure of the closed space is close to the atmospheric pressure.

Accordingly, it is possible to judge that there is a failure or breakdown if the pressure level within the closed space is in a predetermined range (atmospheric pressure±set pressure), after elapsed a predetermined period of time (set period) since the formation of the closed space. Also, it is possible to judge that there is no failure or breakdown if the pressure level is out of the range.

However, in such an evapopurge system, there is a fear that, if the failure diagnosing process is performed when the fuel is supplied to the fuel reservoir during the operation of the internal combustion engine, such a wrong diagnosis is made that the failure is present in spite of the condition that there is no failure or breakdown.

In other words, when the diagnosis process is performed during the operation of the internal combustion engine, if the fuel supply gun is inserted into a fuel supply inlet of the fuel reservoir, the atmospheric air is supplied to the fuel reservoir tank, the closed space formed for the failure diagnosis is opened so that the pressure within the closed space is substantially the same as the atmospheric pressure. In this case, since the pressure behavior of the closed space shows the same process as in the case of the breakdown of the vapor passage, the failure diagnosing apparatus judges that there is any failure or breakdown.

Incidentally, there has been proposed a conventional failure diagnosing apparatus for an evapopurging system, in which the presence/absence of the breakdown is judged on the basis of the temperature change of the canister instead of the presence/absence of the breakdown on the basis of the behavior of the pressure within the closed space. In this system, the phenomenon that the temperature within the canister is elevated when the adsorbent adsorbs the evaporated fuel is utilized. When the vapor passage is damaged so that the evaporated fuel is caused to flow through the failure part, the amount of fuel adsorption by the adsorbent is small. Accordingly, the temperature elevation rate of the canister is low. The system bases on this phenomenon.

By the way, since the large amount of evaporated fuel is present during the fuel supply and is adsorbed to the canister, even if the failure is present in the vapor passage and the fuel is discharged to the atmosphere therethrough, the amount of the vapor generated from the supplied fuel is larger to thereby elevate the canister. As a result, even in the failure diagnosing apparatus for judging the presence/absence of the failure while supervising the temperature change of the canister, when the failure diagnosis is performed during the fuel supply, there is a fear that a wrong diagnosis that there is no failure or breakdown would be made even if there is a failure or breakdown.

SUMMARY OF THE INVENTION

In view of the above-noted problems, an object of the present invention is to provide a technology for preventing misdiagnosis by forbidding a failure diagnosing process in the case where fuel supply is performed during the operation of an internal combustion engine.

In order to attain this and other objects, the present invention provides the following means.

Namely, according to the present invention, there is provided a failure diagnosing apparatus for an evapopurge system, comprising: an evaporated fuel processing apparatus for adsorbing fuel evaporated within a fuel reservoir by an adsorbent and for purging the evaporated fuel, adsorbed by the adsorbent, to an intake system of an internal combustion engine at any time as desired: a failure judgement means for judging absence/presence of a failure of the evaporated fuel processing apparatus; an internal combustion engine operation judging means for judging whether or not the internal combustion engine is in operation; a judgement means upon fuel supply for judging whether or not the fuel is supplied to the fuel reservoir; and a failure judgement forbidding means for forbidding the failure judgement by the failure judgement means when it is judged by the internal combustion engine operation judging means and the judgement means upon fuel supply that the internal combustion engine is in operation and the fuel is supplied.

In the thus constructed failure diagnosing apparatus for an evapopurge system, first of all, it is judged by the internal combustion engine operation judging means whether or not the internal combustion engine is in operation. Then, if it is judged by the internal combustion engine operation judging means that the internal combustion engine is out of operation, the failure judgement means does not execute the failure diagnosing process.

Also, if it is judged by the internal combustion engine operation judging means that the internal combustion engine is in operation, the failure judgement means is started so that it is judged whether or not the fuel supply is effected. In this case, if it is judged by the judgement means upon fuel supply that the fuel is supplied, the failure judgement forbidding means forbids the failure judgement process by the failure judgement means. Also, if it is judged by the judgement means upon fuel supply that the fuel is not supplied, the failure judgement forbidding means allows the failure judgement means to execute the failure judgement process.

By thus forbidding the failure diagnosing process during the fuel supply, the misdiagnosis is prevented in advance and a reliability of the failure diagnosing apparatus for the evapopurge system is enhanced.

Incidentally, the judgement of absence/presence of the failure in the evaporated fuel processing apparatus may be performed on the basis of, for example, changing factors such as a pressure within the evaporated fuel processing apparatus, a temperature within the canister and the like.

DETAILED DESCRIPTION OF THE PREFERRED EMBODIMENTS

A failure diagnosing apparatus for an evapopurging system according to embodiments of the invention will now be described with reference to FIGS. 1 to 16. Incidentally, the embodiments that will be explained are examples of automotive internal combustion engines to which the invention is applied.

Embodiment 1

Figure 1:
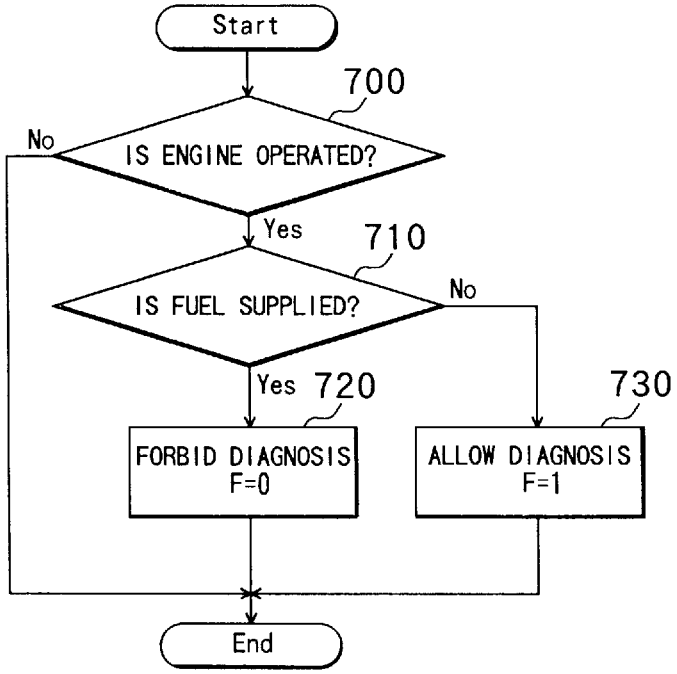
FIG. 1 is a principle structure view showing a failure diagnosing apparatus for an evapopurge system according to the present invention.
Figure 2:
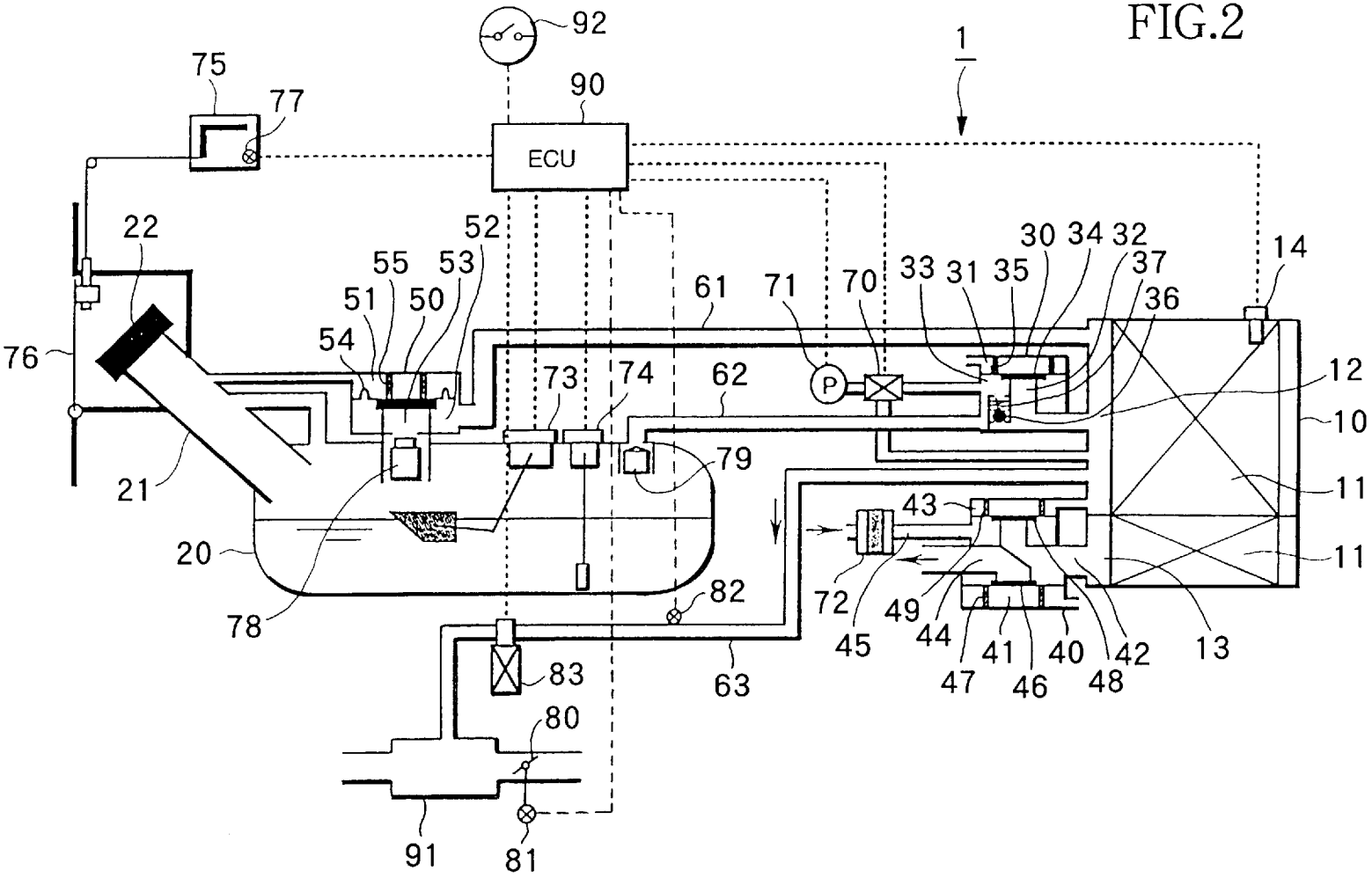
FIG. 2 is a structural view showing an evaporated fuel processing apparatus in accordance with a first embodiment in the failure diagnosing apparatus for an evapopurge system according to the present invention.

A structure of a evaporated fuel processing apparatus 1 in accordance with a first embodiment of an evapopurge system of the invention will first be explained with reference to FIG. 2.

An interior of a canister 10 is filled with an activated charcoal 11 as an adsorbent. Then, the canister 10 is connected to a fuel reservoir 20 through a breezer line 61 and an evapoline 62, connected to an intake pipe 91 of the internal combustion engine 91 through a purge line 63 and connected to the atmosphere through an atmospheric suction/discharge valve 40. Also, an activated charcoal temperature sensor 14 for detecting a temperature of the activated charcoal 11 is mounted on the canister 10. A detection signal of the activated charcoal temperature sensor 14 is inputted into an electronic control unit (ECU) 90 for controlling the engine.

The ECU 90 is composed of a central processing unit (CPU), a read-only memory (ROM), a random access memory (RAM) and the like (none of them are shown). Connected to the ECU 90 are various sensors such as a throttle sensor, a water temperature sensor, an air flow meter. The output signals from these sensors are inputted into the ECU 90. The ECU 90 controls various controls such as an air/fuel ratio control and a fuel injection control for the internal combustion engine on the basis of the output signals of the respective sensors and performs a failure diagnosis process which is related to the subject matter of the present invention.

A fuel reservoir internal pressure controlling valve 30 is mounted on a diffusion chamber 12, on the fuel reservoir connection side, of the canister 10. The reservoir internal pressure controlling valve 30 has a first pressure chamber 31 in communication with the atmosphere, a second pressure chamber 32 in communication with the diffusion chamber 12 on the fuel reservoir connection side, and a third pressure chamber 33 in communication with the evapoline 62. The second pressure chamber 32 and the third pressure chamber 33 are separated from the first pressure chamber 31 by a diaphragm 34.

The diaphragm spring 34 is biased in a valve closed direction by a spring 35 to thereby interrupt the second pressure chamber 32 and the third pressure chamber 33 under the valve closed condition. When the internal pressure within the fuel reservoir 20 becomes a positive pressure that is equal to or higher than a set pressure, the reservoir internal pressure controlling valve 30 opens against the elastic force of the spring 35 so that the second pressure chamber 32 and the third pressure chamber 33 are in communication with each other and the evaporated fuel within the fuel reservoir 20 may be purged to the canister 10 through the evapoline 62.

Also, the second pressure chamber 32 and the third pressure chamber 33 may be in communication with each other or out of communication with each other by a back purge valve 36. Namely, the back purge valve 36 is biased in a valve closed direction by a spring 37. When the internal pressure of the fuel reservoir 20 is less than a predetermined negative pressure (its absolute value is increased), the valve is opened against the elastic force of the spring 37 so that the second pressure chamber 32 and the third pressure chamber 33 are in communication with each other and the air is introduced into the fuel reservoir 20 through an atmospheric suction/discharge valve 40, the canister 10 and the evapoline 62.

The diffusion chamber 12, on the fuel reservoir connection side, of the canister 10 and the third pressure chamber 33 of the reservoir internal pressure controlling valve 30 may be in communication with a pressure sensor 71 through a three way valve 70, respectively. The three way valve 70 has a function of switching and communicating the pressure sensor 71 and one of the second pressure chamber 32 and the diffusion chamber 12 on the basis of the electric signal outputted from the ECU 90. Incidentally, normally, the three-way valve 70 takes a position for communicating the third pressure chamber 33 and the pressure sensor 71 to each other. The detection signal of the pressure sensor 71 is inputted into the ECU 90.

An atmospheric suction/discharge valve 40 is mounted on the diffusion chamber 13, on the atmospheric side, of the canister 10. The atmospheric suction/discharge valve 40 is provided with a first pressure chamber 41 in communication with the atmosphere, a second pressure chamber 42 in communication with the diffusion chamber 13, on the atmospheric side, of the canister 10, a third pressure chamber 43 in communication with the diffusion chamber 12, on the fuel reservoir connection side, of the canister 10, a discharge chamber 44 released to the atmosphere, and a suction chamber 45 connected to the atmosphere through an air cleaner 72.

The second pressure chamber 42 and the discharge chamber 44 are separated from the first pressure chamber 41 by a diaphragm 46 which is biased in a valve closed direction by a spring 47 to thereby interrupt the second pressure chamber 42 and the discharge chamber 44 in the valve closed condition. In the atmospheric suction/discharge valve 40, when the internal pressure of the canister 10 becomes a positive pressure that is equal to or higher than a predetermined value, the diaphragm 46 operates in the valve opened direction against the elastic force of the spring 47, the second pressure chamber 42 and the discharge chamber 44 are in communication with each other and the air within the canister 10 may be discharged to the atmosphere.

On the other hand, the second pressure chamber 42 and a suction chamber 45 is separated from the third pressure chamber 43 by a diaphragm 48. The diaphragm 48 is biased in a valve closed direction by a spring 49 to thereby interrupt the communication between the second pressure chamber 42 and the suction chamber 45 in the closed condition. In the atmospheric suction/discharge valve 40, when the internal pressure of the canister 10 becomes a negative pressure that is lower than a predetermined negative value (its absolute value is greater than the predetermined pressure), the diaphragm 48 operates in the valve opened direction against the elastic force of the spring 49, the second pressure chamber 42 and the suction chamber 45 are in communication with each other and the atmospheric air may be sucked into the canister 10.

Namely, the atmospheric suction/discharge valve 40 discharges the air to the canister 10 when the internal pressure of the canister 10 becomes the positive pressure that is equal to or higher than the predetermined level, and sucks the air into the canister when the internal pressure is lower than the predetermined negative pressure so that it functions to maintain the internal pressure of the canister 10 within the predetermined pressure range.

A vacuum switching valve (hereinafter simply referred to as a VSV) 83 is provided in the vicinity of the connection with the intake pipe 91 in the purge line 63. The ECU 90 performs a duty control of the opening degree of the VSV 83 in response to the operational condition of the internal combustion engine. Also, a purge vapor concentration sensor 82 is disposed upstream of the VSV 83 in the purge line 63 for outputting an electric signal in correspondence with the vapor concentration within the purge line 63. The output signal of the purge vapor concentration sensor 82 is inputted into the ECU 90.

On the other hand, a differential pressure valve 50 is provided above the fuel reservoir 20. The differential pressure valve 50 is provided with a first pressure chamber 51 in communication with a fuel supply pipe 21 of the fuel reservoir 20, a second pressure chamber 52 in communication with the breezer line 61, and a third pressure chamber 53 in communication with an upper portion of the fuel reservoir 20. The second pressure chamber 52 and the third pressure chamber 53 are separated from the first pressure chamber 51 by a diaphragm 54.

The diaphragm 54 is biased in a valve closed condition by a spring 55 to interrupt the communication between the second pressure chamber 52 and the third pressure chamber 53 in the valve closed condition. The differential pressure valve 50 is opened against the elastic force of the spring 55 when a cap 22 of a fuel reservoir 20 is opened and the fuel supply is started so that the internal pressure of the fuel reservoir 20 is equal to or higher than the predetermined value. As a result, the second pressure chamber 52 and the third pressure chamber 53 are communicated with each other and the evaporated fuel within the fuel reservoir 20 is discharged to the canister 10 through the breezer line 61.

Also, a fuel temperature sensor 74 for outputting an electric signal in correspondence with the fuel temperature and a fuel gauge 73 for detecting the fuel amount of the fuel reservoir 20 are provided in the fuel reservoir 20. The output signals of the fuel temperature sensor 74 and the fuel gauge 73 are inputted into the ECU 90.

The cap 22 is detachably mounted at the end of the fuel supply pipe 21 of the fuel reservoir 20, and is received inside of the fuel lid 76 that may be opened by a lid opener 75. An open state sensor 77 for detecting that the lid opener 75 is operated to open the lid is provided in the lid opener 75. The output signal of the open state sensor 77 is inputted to the ECU 90.

Also, the fuel reservoir 20 is provided a float valve 78 for interrupting the communication between the fuel reservoir 20 and the third pressure chamber 53 of the differential pressure valve 50 when the fuel reservoir 20 is fully filled with the fuel during the fuel supply operation, a roll over valve 79 which is normally opened but is closed when the vehicle is rolled over or turned over.

Furthermore, a throttle valve 80 disposed in the intake pipe 91 is provided with a throttle opening degree sensor (not shown) provided with an idle switch 81 that outputs an idle signal "ON" when the opening degree of the throttle valve 80 is "zero". The output signal of the idle switch 81 is fed to the ECU 90.

Also, an ON/OFF signal of the ignition switch 92 is inputted into the ECU 90. It is possible for the ECU 90 to judge from the ON/OFF signal from the ignition switch 92 whether the internal combustion engine is in operation or at a standstill.

The evapopurge system in accordance with this embodiment will operate as follows.

When the evaporated fuel generated when the temperature of the fuel within the fuel reservoir 20 is elevated is introduced through the evapoline 62 into the reservoir internal pressure controlling valve 30 and the pressure within the fuel reservoir 20 reaches a level equal to or higher than the predetermined level, the evaporated fuel is discharged to the canister 10 and adsorbed to the activated charcoal 11. At this time, the pressure within the canister 10 is controlled to a predetermined positive pressure by the atmospheric suction/discharge valve 40.

When the temperature of the fuel within the fuel reservoir 20 is lowered and the pressure within the fuel reservoir 20 is reduced to a level that is equal to or lower than the predetermined level, the discharge of the evaporated fuel from the fuel reservoir 20 to the canister 10 is stopped.

When the temperature of the fuel within the fuel reservoir 20 is further lowered so that the pressure within the fuel reservoir 20 reaches the predetermined negative value, the back purge valve 36 is opened. The atmospheric air is introduced into the fuel reservoir 20 through the atmospheric suction/discharge valve 40, the canister 10 and the evapoline 62. The negative pressure within the fuel reservoir 20 is controlled to the predetermined pressure to thereby prevent the damage of the fuel reservoir 20.

If the internal combustion engine is started, and thereafter, the purge condition is met, the VSV 83 is opened so that the negative pressure of the suction pipe 91 is introduced through the purge line 63 into the canister 10. When the pressure within the canister 10 reaches the predetermined negative pressure, the atmospheric pressure is introduced into the canister 10 through the atmospheric air suction/discharge valve 40 so that the evaporated fuel adsorbed to the activated charcoal 11 is purged and the purged evaporated fuel is fed to the internal combustion engine.

As the evaporated fuel is purged to the internal combustion engine, the negative pressure within the canister 10 is controlled at substantially constant pressure by the atmospheric suction/discharge valve 40, and the opening degree of the VSV 83 is duty controlled by the ECU 90 so that the purge flow rate does not affect the exhaust emission by the purge gas.

Also, in the case where the lid opener 75 is operated and the fuel lid 76 is opened so that fuel is supplied, the pressure within the fuel reservoir 20 is increased by the fuel supply. At this case, when the pressure within the fuel reservoir 20 reaches the predetermined pressure, the differential pressure valve 50 is opened and the evaporated fuel filled in the fuel reservoir 20 before the fuel supply or the evaporated fuel due to the fuel supply are introduced through the breezer line 61 into the canister 10 and adsorbed to the activated charcoal 11.

The failure diagnosing process routine of the evapopurge system in accordance with this embodiment will now be described.

In principle of the failure diagnosing process routine, first of all, it is judged whether or not the internal combustion engine is operated (step 700). In step 700, if it is judged that the internal combustion engine is not operated, the failure diagnosing process is not performed.

Also, in step 700, if it is judged that the internal combustion engine is operated, the program advances to step 710 and the judgement is made as to whether or not the fuel supply is effected. In step 710, if it is judged that the fuel supply is effected, the execution of the failure diagnosing process is forbidden (step 720).

Also, in step 710, if it is judged that the fuel supply is not effected, the execution of the failure diagnosing process is allowed (step 730).

Then, in this embodiment, the failure diagnosing process is separated into a system on the reservoir side and a system on the canister side. The system on the reservoir side means a system including the fuel reservoir 20, the evapoline 62, the part of the reservoir internal pressure controlling valve 30, and the part of the differential pressure valve 50. The system on the canister side means a system including the canister 10, the breezer line 61, the purge line 63, the part of the reservoir internal pressure controlling valve 30 and the atmospheric air suction/discharge valve 40. The failure diagnosing process routine will now be explained for the respective systems.

(Failure Diagnosing Process on the Reservoir Side)

Figure 3:
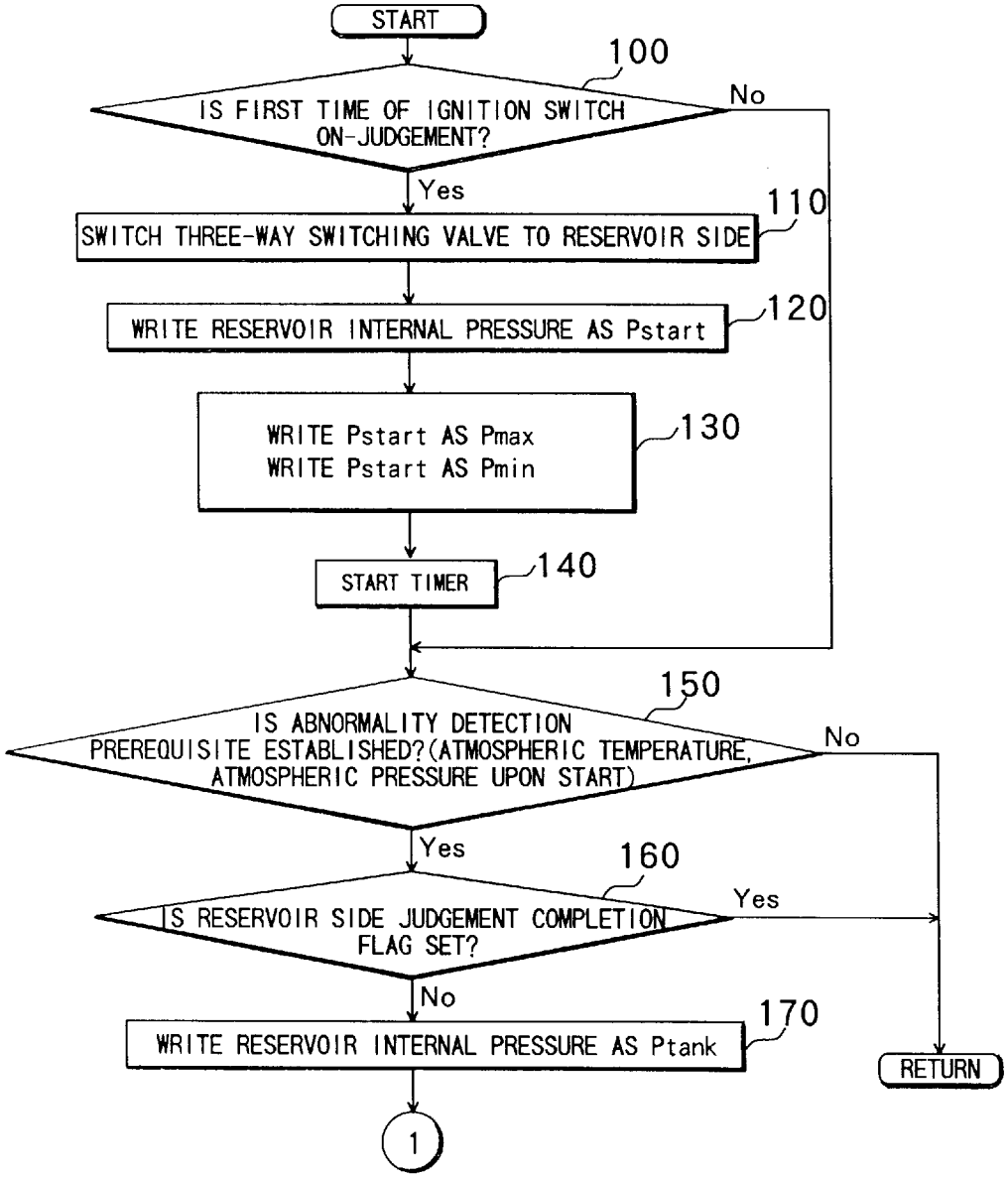
FIG. 3 is a flowchart showing a routine of a failure diagnosing process on a reservoir side in accordance with the first embodiment in the failure diagnosing apparatus for an evapopurge system according to the present invention.
Figure 4:
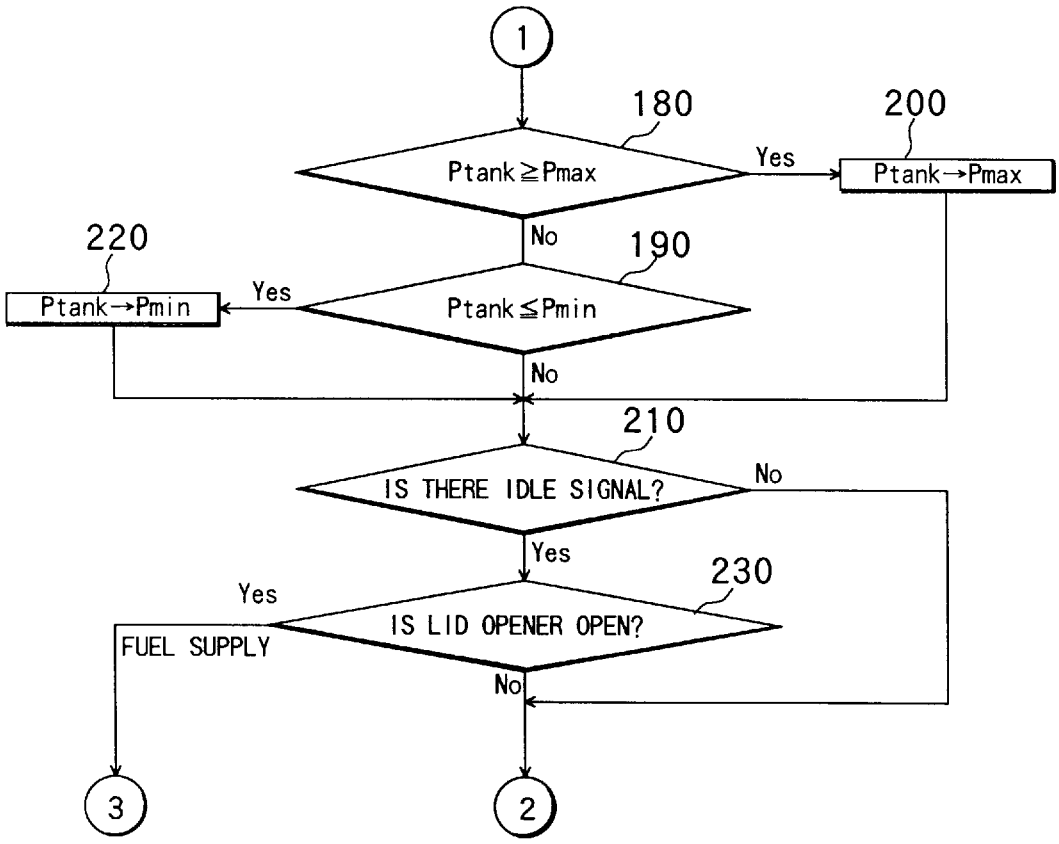
FIG. 4 is a flowchart showing a routine of the failure diagnosing process on the reservoir side in accordance with the first embodiment in the failure diagnosing apparatus for an evapopurge system according to the present invention.
Figure 5:
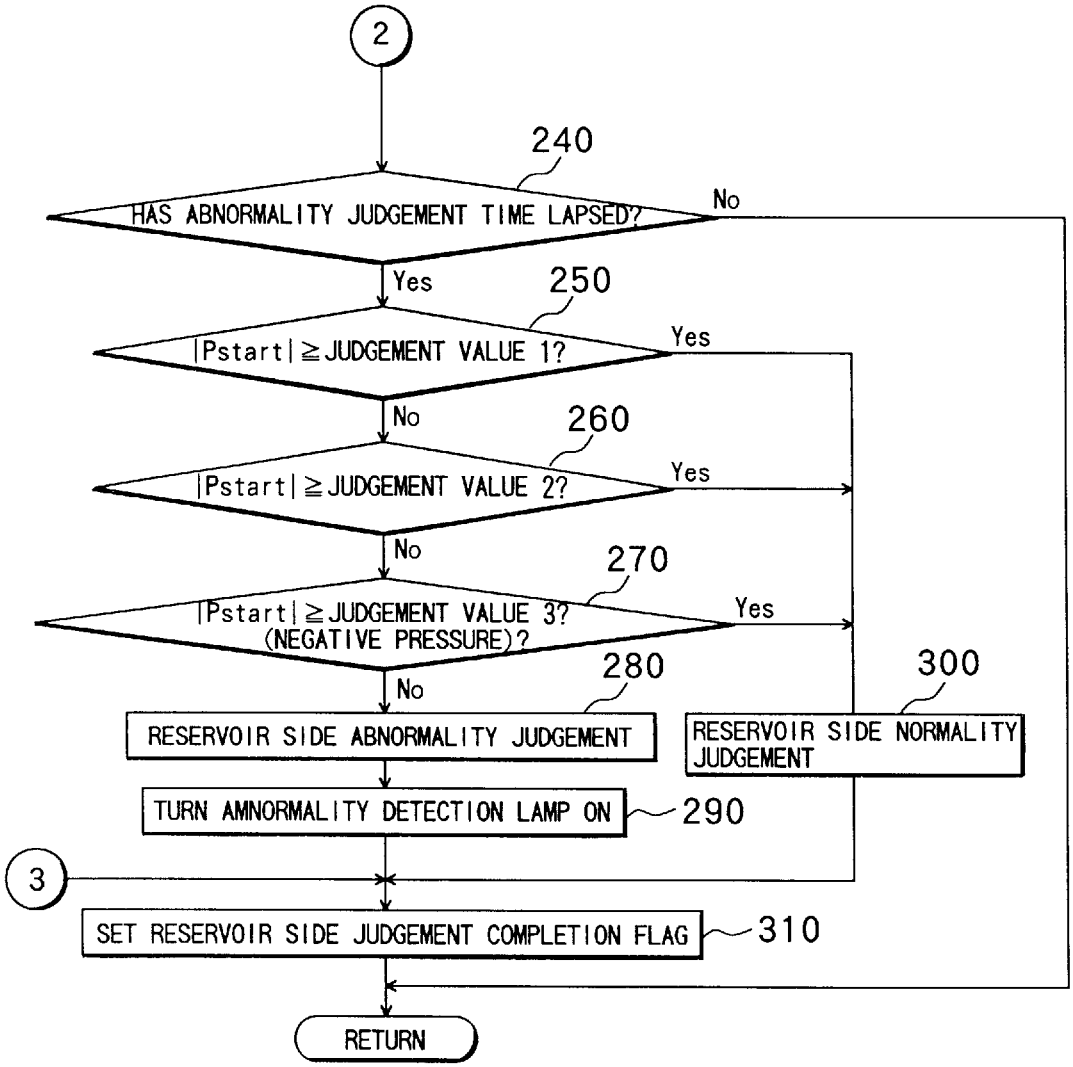
FIG. 5 is a flowchart showing a routine of the failure diagnosing process on the reservoir side in accordance with the first embodiment in the failure diagnosing apparatus for an evapopurge system according to the present invention.

The failure diagnosing process on the reservoir side will first be described. FIGS. 3 to 5 are flowcharts showing the failure diagnosing process on the reservoir side, to be executed by the ECU 90. This process is executed whenever the internal combustion engine is started and every predetermined period of time thereafter.

When the failure diagnosing process on the reservoir side is started, the ECU 90 first judges whether or not the ignition switch ON step is in the first judgement in the routine (step 100). In step 100, when it is judged YES (namely, in the first ON judgement), the three-way switching valve 70 is switched over to the reservoir side (step 110). In this case, the detection signal of the pressure sensor 71 is written in the RAM of the ECU 90 as an initial internal pressure Pstart of the fuel reservoir 20 (step 120).

Subsequently, the initial internal pressure Pstart detected in step 120 is written to the RAM of ECU 90 as Pmax and Pmin (Step 130). Thereafter, the judgement timer is started (step 140) and the program advances to step 150. Also, when the judgement of step 100 is NO (namely, the ignition switch ON operation is in the second judgement onward), the program is advanced from step 100 to step 150.

In step 150, in accordance with the detection signals of the suction air temperature or the suction pressure sensor (which are not shown), the ECU 90 judges whether or not the abnormal detection prerequisite such as a condition as to whether or not the atmospheric temperature or the atmospheric pressure upon the engine start is in the predetermined range is met. In step 150, if it is judged NO, the program is advanced to the return without executing the failure diagnosing process.

In the case where, in step 150, it is judged that the abnormal prerequisite is met, the program is advanced to step 160, and it is judged whether or not a reservoir judgement completion flag is set.

In step 160, when it is judged NO (namely, in the case where the reservoir side judgement completion flag is not set), the detection signal of the pressure sensor 71 at this time is written in the RAM of the ECU 90 as a current internal pressure Ptank of the fuel reservoir 20 (hereafter referred to as a current internal pressure) (step 170).

Subsequently, the current internal pressure Ptank and Pmax are read out from the RAM of the ECU 90, it is judged whether or not the current internal pressure Ptank is equal to or higher than Pmax (step 180). When it is judge YES in step 180 (namely, when the current internal pressure Ptank is equal to or higher than Pmax), Pmax is rewritten to the value of the current internal pressure Ptank (step 200). The program is advanced to step 210.

On the other hand, in step 180, if it is judged NO (namely, when the current internal pressure Ptank is not higher than the Pmax), the program is advanced to step 190, and the current internal pressure Ptank and the Pmin are read out from the RAM of the ECU 90 so that it is judged whether or not the current internal pressure Ptank is equal to or lower than Pmin.

In step 190, when it is judged NO (namely, in the case where the current internal pressure Ptank is not lower than Pmin), the program is advanced to step 210. In step 190, when it is judge YES (namely, when the current Ptank is not higher than Pmin), Pmin is rewritten by the value of the current internal pressure Ptank (step 220). The program is advanced to step 210.

In step 210, it is judged whether or not the idle signal from the idle switch 81 is turned on, and thus it is judged whether the vehicle runs or stops. Namely, when in step 210 it is judged NO, the throttle valve is opened and the internal combustion engine is operated under a high load. Accordingly, it is judged that the vehicle runs, and the program is advanced to step 240.

When it is judged YES in step 210, the throttle valve is under the fully closed condition and the internal combustion engine is in the idle condition. It is judged that the vehicle stops and the program is advanced to step 230. It is judged whether or not the lid opener 75 is operated to be open. When it is judged NO in step 230 (namely, when the lid opener 75 is not operated for opening the cap), the program is advanced to step 240.

On the other hand, in the case where it is judged YES in step 230, the program is advanced to step 310 without executing step 240. The meaning of this process will later be explained in detail.

In step 240, it is judged whether or not a abnormal judgement time has lapsed since the start of the judgement timer. If it is judged that the time has lapsed, it is judged whether or not the absolute value of the initial internal pressure Pstart is equal to or grater than the judgement value of 1 (step 250). When it is equal to or greater than the judgement value of 1, it is judged that the system on the reservoir side is normal (step 300). The program is advanced to step 310 to thereby set the reservoir side judgement completion flag.

When the absolute value of the initial internal pressure Pstart is smaller than the judgement value of 1 (in the case where it is judged NO in step 250), Pmax is read out from the RAM of ECU 90, it is judged whether or not Pmax is equal to or higher than the judgement value of 2 (step 260). When Pmax is not lower than the judgement value of 2, it is judged that the system on the reservoir side is normal (step 300). The program is advanced to step 310 to thereby set the reservoir side judgement completion flag.

When Pmax is lower than the judgement value of 2 (in the case where it is judged NO in step 260), Pmin is read out from the RAM of the ECU 90, it is judged whether or not Pmin is greater than the judgement value of 3 (step 270).

When Pmin is equal to or lower than the judgement value of 3 (when it is judged YES in step 270), it is judged that the system on the reservoir side is normal (step 300). The program is advanced to step 310 to thereby set the reservoir side judgement completion flag.

When Pmin is greater than the judgement value of 3 (when it is judged NO in step 270), it is judged that the system on the reservoir side is abnormal (step 280). The abnormal detection lamp is turned on (step 290). The program is advanced to step 310 to thereby set the reservoir side judgement completion flag.

After step 310, the program is advanced to the return in any case.

Incidentally, in the case where in step 150 it is judged that the abnormal detection prerequisite is not met, in the case where in step 160 it is judged that the reservoir side judgement completion flag is set, or in the case where in step 240 the abnormal judgement time has not lapsed, the program is advanced to the return. Namely, in these cases, the program is advanced to the return without setting the reservoir side judgement completion flag.

Figure 6:
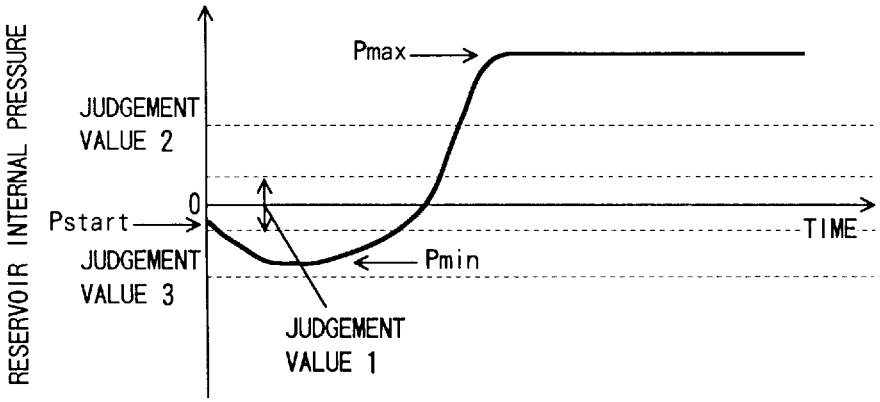
FIG. 6 is a graph showing an example of an internal pressure behavior within the fuel reservoir in accordance with a lapse of time in the failure diagnosis on the reservoir side.

In this case, the basis as to whether the system on the reservoir side is normal or abnormal will be explained. FIG. 6 shows an example of the internal pressure behavior of the fuel reservoir 20 with the lapse of time from the start of the judgement timer and shows an example of the normal judgement in the case where it is judged YES in step 260.

First of all, in the case where the system on the reservoir side is abnormal due to a damage or the like, the internal pressure of the fuel reservoir 20 upon the judgement timer start must show a value close to the atmospheric pressure. Accordingly, when the absolute value of the initial internal pressure Pstart is smaller than the judgement value of 1, there is a possibility to judge that the system has abnormality. Inversely, when the absolute value of the initial internal pressure Pstart is equal to or greater than the judgement value of 1, only from this result, it is possible to judge that the system is normal. This is the basis of the judgement in step 250.

The reason why it is not positively judged that the system on the reservoir side has the abnormality even when the absolute value of the initial internal pressure Pstart is smaller than the judgement value of 1 is that there are some cases where the absolute value of the initial internal pressure Pstart is smaller than the judgement value of 1 even if there is no abnormality in the system on the reservoir side.

Accordingly, in the case where the absolute value of the initial internal pressure Pstart is less than the judgement value of 1, the judgement is made from the maximum internal pressure Pmax or the minimum internal pressure Pmin of the fuel reservoir 20 between the judgement timer start and the lapse of abnormal judgement time. Namely, in the case where there is abnormality such as a damage in the system on the reservoir side, the internal pressure of the fuel reservoir 20 shows a value close to the atmospheric pressure even with the lapse of time for the abnormality judgement.

Almost all the cases where there is no abnormality must show at least once the positive pressure value of the judgement value of 2 or more until the abnormality judgement period lapses or must show the negative pressure value of the judgement value of 3 or less.

Accordingly, the maximum internal pressure Pmax of the fuel reservoir 20 during a period until the abnormality judgement time has lapsed is not smaller than the judgement value of 2 or the minimum internal pressure Pmin is not greater than the judgement value of 3, it is possible to make a judgement that the system on the reservoir side is normal. This is the basis for the judgement in steps 260 and 270.

By the way, when the fuel supply gun is inserted into the fuel reservoir 20 upon the fuel supply, the atmospheric air is introduced into the reservoir tank 20 so that the internal pressure within the fuel reservoir 20 is kept substantially at the atmospheric pressure. If the failure diagnosing process on the reservoir side is performed under such cases, there is a fear that the system on the reservoir side judges that there is a breakdown such as a damage on the reservoir side.

Accordingly, in this embodiment, when the idle signal is judged to be ON in step 210, and it is judged in step 230 that the lid opener 75 is operated to be open, it is judged that the fuel supply is effected during the operation of the internal combustion engine to thereby complete the failure diagnosing process on the reservoir side without effecting the function of step 240. Thus, the misdiagnosis of the failure diagnosing apparatus for the evapopurge system is avoided during the fuel supply.

Incidentally, in the above embodiment, the stop condition of the vehicle is judged by the idle signal. However, instead thereof, by the detection signal of the sensor for detecting a parking brake condition or a vehicle velocity signal detected by a vehicle velocity sensor, it is possible to make a judgement as to whether or not the vehicle stops. Alternatively, it is possible o make the decision by the combination of the idle signal and these detection signals. This is the same in the failure diagnosing process on the canister side which will be explained as follows. Also, this modification may be applied equally to a second embodiment to a sixth embodiment to be described later.

(Failure Diagnosing Process on the Canister Side)

Figure 7:
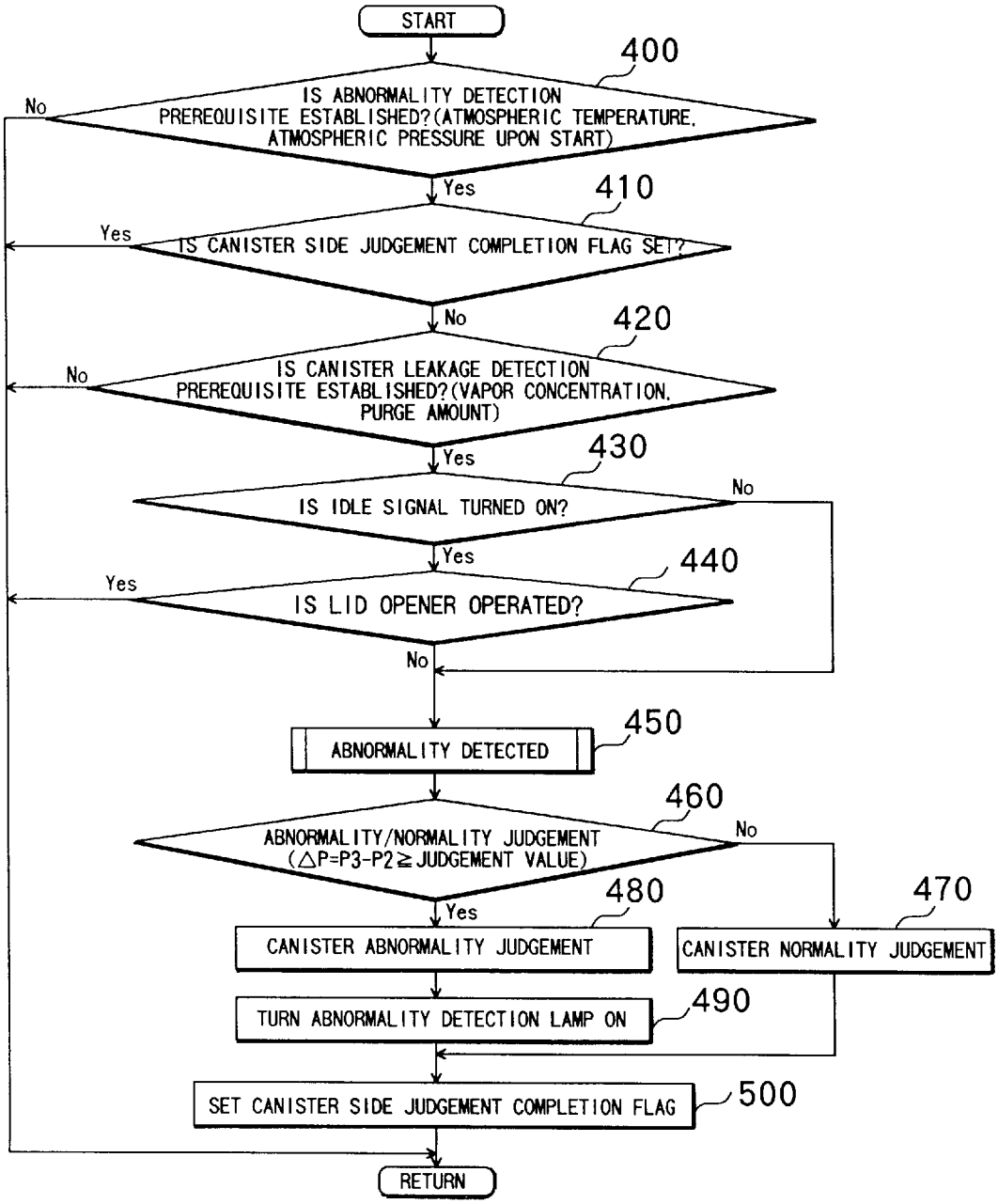
FIG. 7 is a flowchart showing a routine of a failure diagnosing process on a canister side in accordance with the first embodiment in the failure diagnosing apparatus for an evapopurge system according to the present invention.
Figure 8:
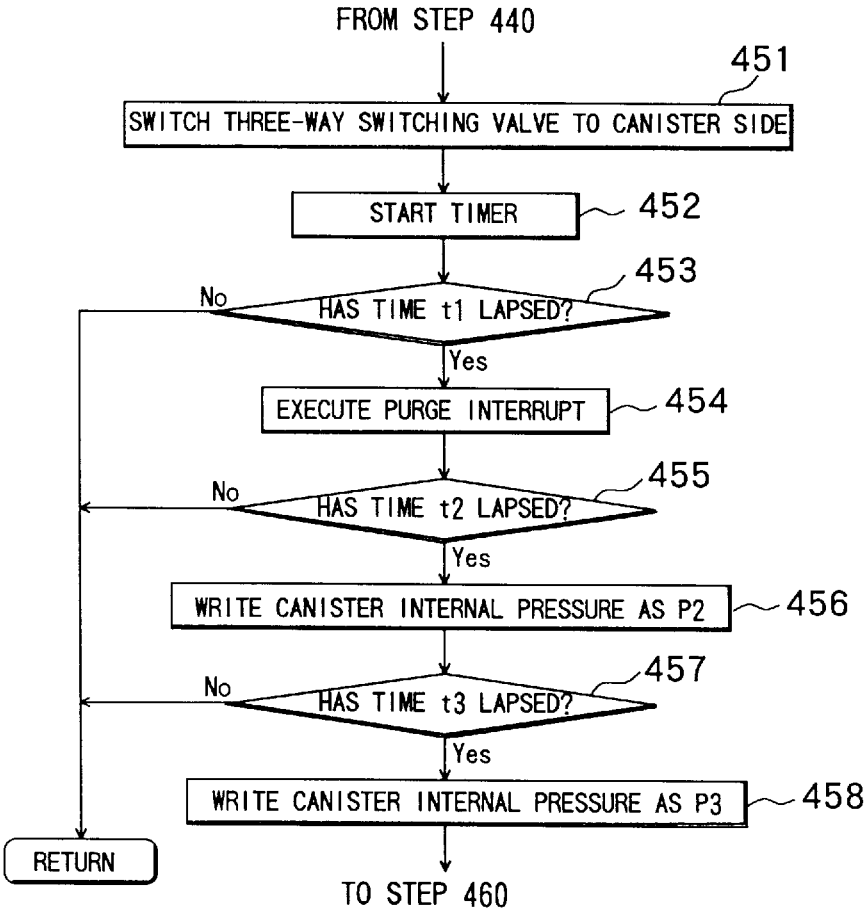
FIG. 8 is a flowchart showing a routine of the failure diagnosing process on the canister side in accordance with the first embodiment in the failure diagnosing apparatus for an evapopurge system according to the present invention.

The failure diagnosing process on the canister side will now be described. FIGS. 7 and 8 are flowcharts showing the failure diagnosing process on the canister side to be executed by the ECU 90. This process is executed after the failure diagnosing process on the reservoir side upon the starting operation of the internal combustion engine, for example. Thereafter, this process is executed every predetermined period of time.

When the failure diagnosing process on the canister side is started, the ECU 90 first judges whether or not the abnormality detection prerequisite is met (step 400). In this case, the abnormality detection prerequisite is the same as in step 150 in the failure diagnosing process on the reservoir side. In the case where in step 400 it is judged NO, there is a fear of the wrong diagnosis. Accordingly, the program is advanced to the return without effecting the failure diagnosing process.

In the case where it is judged YES in step 400, it is judged whether or not the canister side judgement completion flag is set (step 410). The canister side judgement completion flag will be reset in a predetermined period of time after the canister side judgement completion flag has been set in step 500 and the time of start of the internal combustion engine. When the canister side judgement completion flag is set, the program is advanced to the return without effecting the failure diagnosing process.

When it is judge NO in step 410 (when the canister side judgement completion flag is not set), it is judged whether or not the canister leakage detection condition is met (step 420). The canister leakage detection condition is met when it is judged on the basis of the detection signals of the vapor concentration or the purge amount that the purge negative pressure is stable.

When it is judged NO in step 420, it is shown that the purge negative pressure is unstable, and there is a fear of the misdiagnosis. Accordingly, the program is advanced to the return without effecting the failure diagnosing process.

When it is judged YES in step 420, it is judged whether or not the idle signal from the idle switch 81 is turned ON. As a result, it is judged whether or not the vehicle runs (step 430).

When it is judged NO in step 430, it is judged that the internal combustion engine is under the high load operation while opening its throttle valve. According, it is judged that the condition is the running operation so that the program is advanced to step 450 to process the abnormality detection.

When it is judged YES in step 430, it is judged that the internal combustion engine is under the idle condition while fully closing the throttle valve and the vehicle is stopped so that the program is advanced to the next step 440.

In step 440, it is judged whether or not the lid opener 75 is operated. If it is judged NO (namely, in the case where the lid opener 75 is not opened), the abnormality detection process is executed (step 450).

On the other hand, in the case where it is judged YES in step 440, the program is advanced to the return without any failure diagnosing process. This will be explained in detail later.

FIG. 8 is a flowchart showing a content of step 450. First of all, the three-way switching valve 70 is switched to the canister side (step 451). Subsequently, the timer is started (step 452).

Then, it is judged whether or not time t1 has lapsed from the timer start (step 453). When time t1 has lapsed, the VSV 83 is operated to the fully close condition so that the purge interruption is effected (step 454).

Subsequently, it is judged whether or not time t2 has lapsed from the timer start (step 455). When time t2 has lapsed, the detection signal of the pressure sensor 71 at this time is written in the RAM of ECU 90 as an internal pressure P2 of the canister 10 (step 456).

Subsequently, it is judged whether or not time t3 has lapsed from the timer start (step 457). When time t3 has lapsed, the detection signal of the pressure sensor 71 at this time is written in the RAM of ECU 90 as an internal pressure P3 of the canister 10 (step 458).

Subsequently, the program is advanced to step 460 for judgement of normality/abnormality. Namely, the ECU 90 reads out P2 and P3 written in the RAM, calculates the differential pressure $\Delta P = P3 - P2$, judges that the condition is normal if the differential pressure $\Delta P$ is smaller than the judgement value (step 470), and sets the canister side judgement completion flag (step 500) to complete the failure diagnosing process.

On the other hand, if the differential pressure $\Delta P$ is greater than the judgement value, it is judged as abnormal (step 480). The abnormality detection lamp is turned on (step 490). The canister side judgement completion flag is set (step 500) to thereby complete the failure diagnosing process.

Incidentally, in the case where times t1, t2 and t3 have not lapsed in steps 453, 455 and 457, respectively, the program is advanced to the return.

Figure 9:
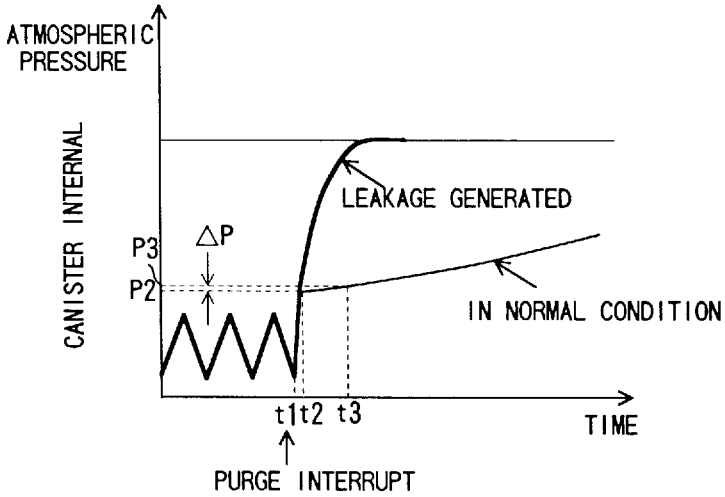
FIG. 9 is a graph showing an example of an internal pressure behavior within the fuel reservoir in accordance with a lapse of time in the failure diagnosis on the canister side.

FIG. 9 shows an example of the internal pressure behavior of the canister 10 in accordance with the lapse of time from the timer start. If the condition is normal, the internal pressure of the canister 10 after the purge interruption is increased at a very small change rate. In contrast, if there is any abnormality, since the atmospheric air is introduced through a damaged part, the internal pressure is increased at a very large change rate. Accordingly, it is possible to make a judgement of normality/abnormality by comparing the above-described differential pressure ΔP with the judgement value.

By the way, upon the fuel supply, since the evaporated fuel generated by the fuel supply or the evaporated fuel that is present in the fuel reservoir 20 is discharged to the canister 10, the pressure within the canister 10 during the purge interruption is rapidly increased. The internal pressure of the canister 10 takes the same behavior as that in the case of the abnormality. Accordingly, there is a fear of misdiagnosing if the failure diagnosing process on the canister side is performed during the fuel supply.

Therefore, in this embodiment, when it is judged that the idle signal is ON in step 430 and it is further judged that the lid opener 75 is operated to the open condition in step 440, it is judged that the internal combustion engine is operated and the condition is under the fuel supply. The program is advanced to the return without advancing step 450 and without performing any failure diagnosing process on the canister side. Thus, the misdiagnosing operation of the failure diagnosing apparatus for the evapopurge system during the fuel supply is avoided in advance.

In the first embodiment, the ECU 90 realizes the failure judgement means together with the pressure sensor 71, realizes the internal combustion engine operation judgement means together with the ignition switch 92 and the judgement means upon the fuel supply together with the opening degree sensor 77. Also, the ECU 90 realizes the failure judgement preventing means.

Embodiment 2

Figure 10:
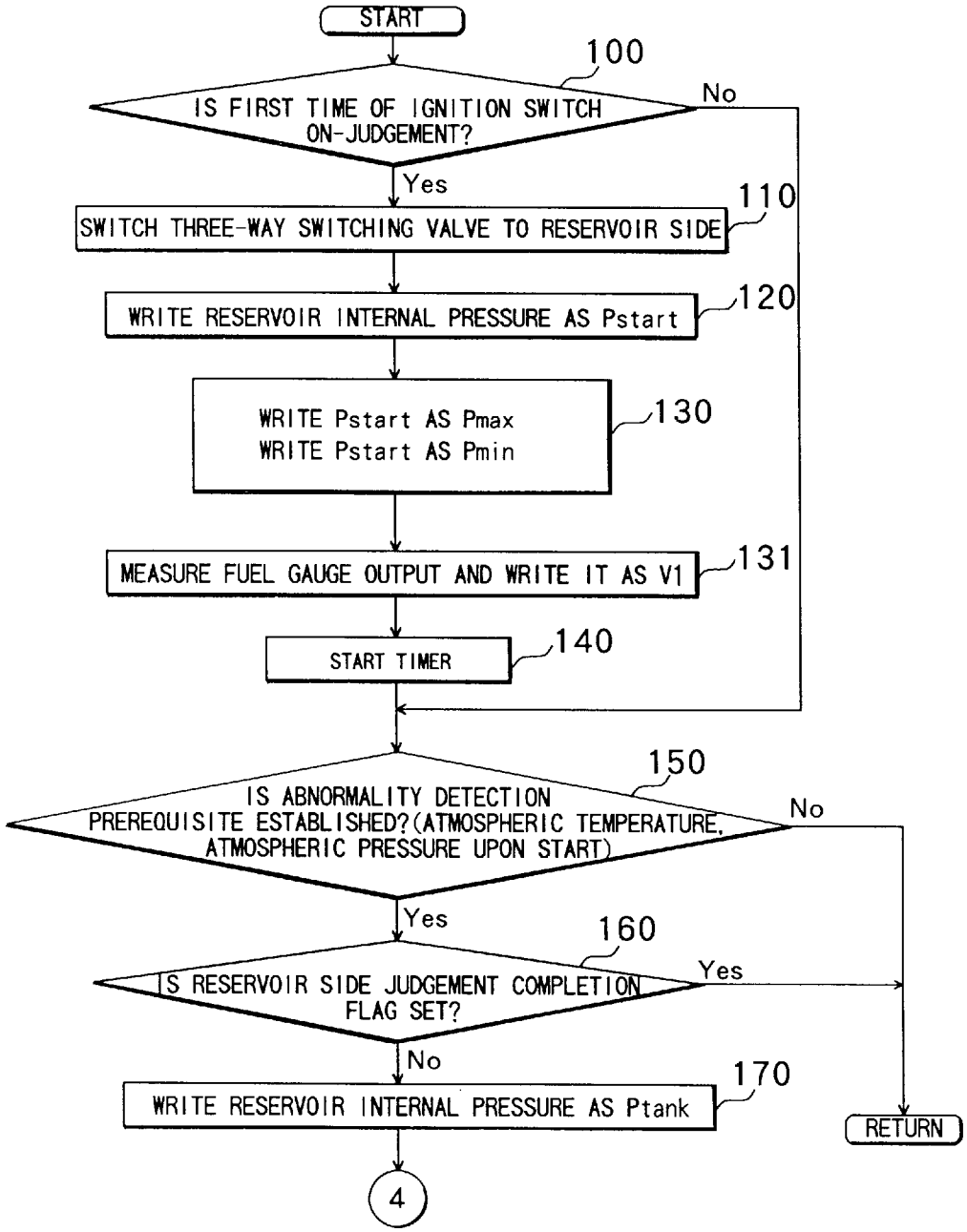
FIG. 10 is a flowchart showing a routine of a failure diagnosing process on a reservoir side in accordance with a second embodiment in a failure diagnosing apparatus for an evapopurge system according to the present invention.
Figure 11:
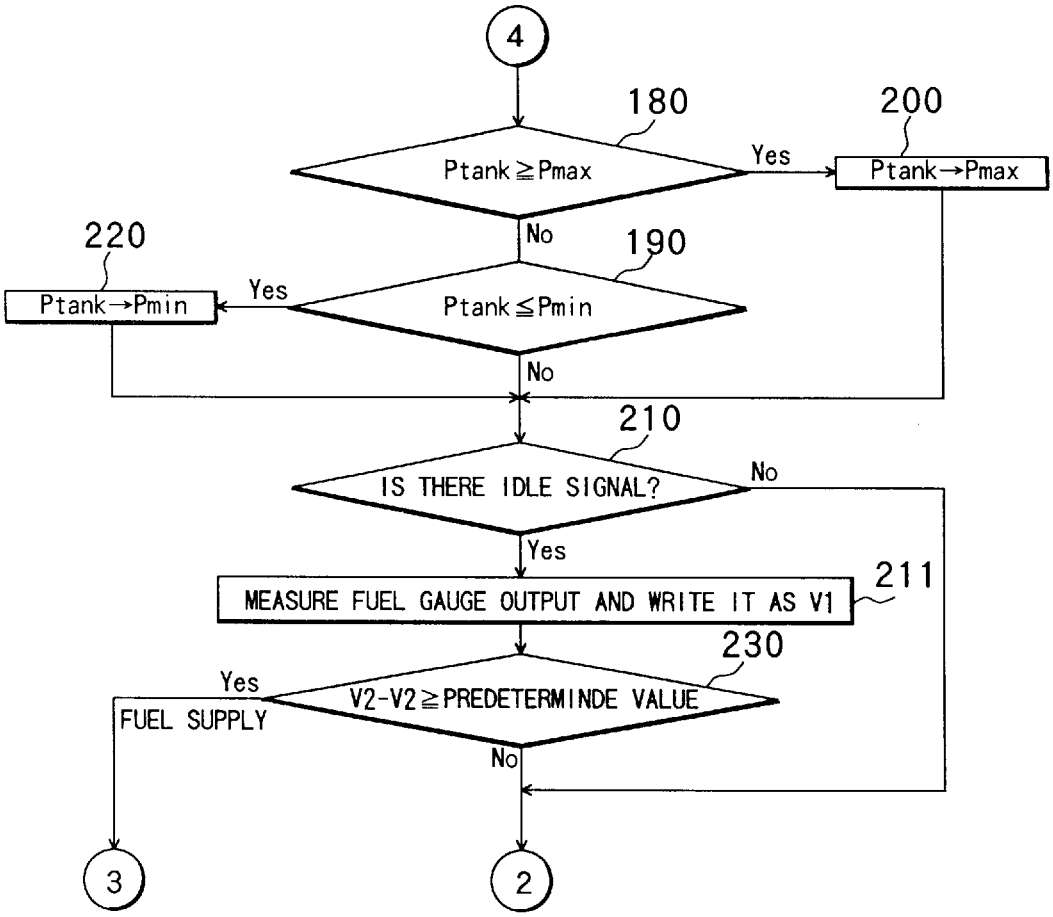
FIG. 11 is a flowchart showing a routine of a failure diagnosing process on the reservoir side in accordance with the second embodiment in the failure diagnosing apparatus for an evapopurge system according to the present invention.
Figure 12:
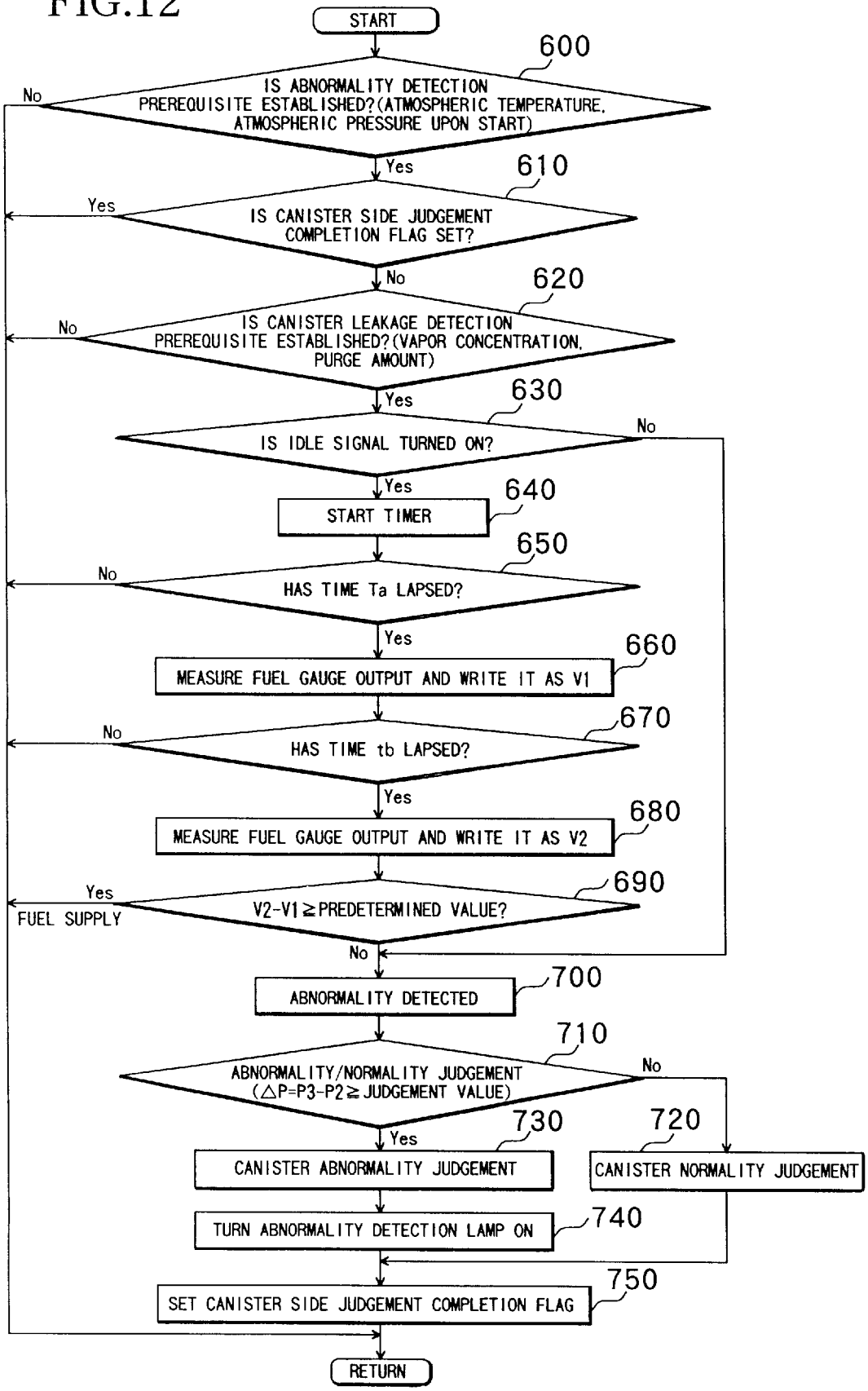
FIG. 12 is a flowchart showing a routine of a failure diagnosing process on a canister side in accordance with the second embodiment in the failure diagnosing apparatus for an evapopurge system according to the present invention.

A failure diagnosing apparatus for an evapopurge system according to a second embodiment of the invention will now be described with reference to FIGS. 10 to 12.

The overall structure of the evaporated fuel processing apparatus 1 is the same as that of the first embodiment, and therefore, the description thereof will be omitted. The explanation will be made as to a process routine of the failure diagnosing separately for the fuel reservoir side and the canister side.

In the first embodiment, according to a condition as to whether or not the lid opener 75 is operated to the open condition, it is judged whether or not the condition is in the fuel supply. However, in the second embodiment, the increasing/decreasing rate of the fuel amount is detected on the basis of the output signal of the fuel gauge 73 to thereby make a judgement as to whether or not the condition is in the fuel supply. In other words, in the second embodiment, it is possible to realize the judgement means upon the fuel supply by using the ECU 90 and the fuel gauge 73.

(Failure Diagnosing Process On Reservoir Side)

First of all, the failure diagnosing process for the system on the reservoir side will be described with reference to FIGS. 10 and 11.

The explanation for steps 100 to 130 will be omitted because these steps are the same as those of the first embodiment.

In the second embodiment, after Pmax and Pmin are written in the RAM of the ECU 90 in step 130, the output of the fuel gauge 73 is written as V1 in the RAM of the ECU 90 (step 131). Then, the timer is started (step 140).

The explanation for steps 140 to 210 will be omitted because these steps are the same as those of the first embodiment.

In the second embodiment, when it is judged that the idle signal is ON in step 210, the output of the fuel gauge 73 is written as V2 in the RAM of the ECU 90 (step 211).

Subsequently, the program is advanced to step 230. V1 and V2 are read out from the RAM of the ECU 90. V2-V1 is calculated. It is judged whether or not its value is not smaller than a predetermined value. In the case where V2-V1 is not smaller than the predetermined value (in the case where it is judged YES in step 230), it is judged that the condition is the fuel supply since the amount of fuel is increased although the internal combustion engine is operated. The program is advanced to step 310 (see FIG. 5). The reservoir side judgement completion flag is set. The program is advanced to the return.

In the case where V2-V1 is smaller than the predetermined value, it is judged that the condition is not the fuel supply. The program is advanced to step 240 (see FIG. 5). The failure diagnosing process is continued. Since steps 240 to 310 are the same as those of the foregoing first embodiment, the explanation therefor will be omitted while referring to FIG. 5.

(Failure Diagnosing Process On Canister Side)

The failure diagnosing process for the system on the canister side will now be described with reference to FIG. 12.

Steps 600 to 630 are the same as steps 400 to 430 in the above-described first embodiment. The explanation therefor will be omitted.

In the second embodiment, when it is judged YES in step 630, the timer is started (step 640). Then, it is judged whether or not time ta has lapsed from the timer start (step 650). When time ta has lapsed, the output of the fuel gauge 73 is written as V1 in the RAM of the ECU 90 (step 660).

Next, it is judged whether or not time tb has lapsed from the timer start (step 670). If time tb has lapsed, the output of the fuel gauge 73 is written as V2 in the RAM of the ECU 90 (step 680).

Subsequently, the program is advanced to step 690. V1 and V2 are read out from the RAM of the ECU 90. V2-V1 is calculated. It is then judged whether or not its value is not smaller than a predetermined value. In the case where V2-V1 is not smaller than the predetermined value (in the case where it is judged YES in step 690), it is judged that the condition is the fuel supply since the amount of fuel is increased although the internal combustion engine is operated. The program is advanced to the return without advancing to the abnormality detection from steps 700 onward.

In the case where V2-V1 is smaller than the predetermined value (i.e., in the case where it is judged NO in step 690), it is judged that it is not in the fuel supply, and the program is advanced to step 700 to continue the failure diagnosing process.

The contents of step 700 is the same as that of step 450 in the first embodiment. Its detailed routine is the same as that of step 451 to step 458 in the first embodiment. The explanation therefor will be omitted.

Also, since steps 710 to 750 are the same as steps 460 to 500 of the above-described first embodiment, the explanation thereof will be omitted.

Incidentally, in the case where it is judged that time ta has not lapsed from the timer start in step 650, or it is judged that time tb has not lapsed from the timer start in step 670, the program is advanced to the return.

As described above, also according to the second embodiment, it is possible to prevent the misdiagnosing of the failure diagnosing apparatus for the evapopurge system in the fuel supply operation in the same manner as in the first embodiment.

Embodiment 3

Figure 13:
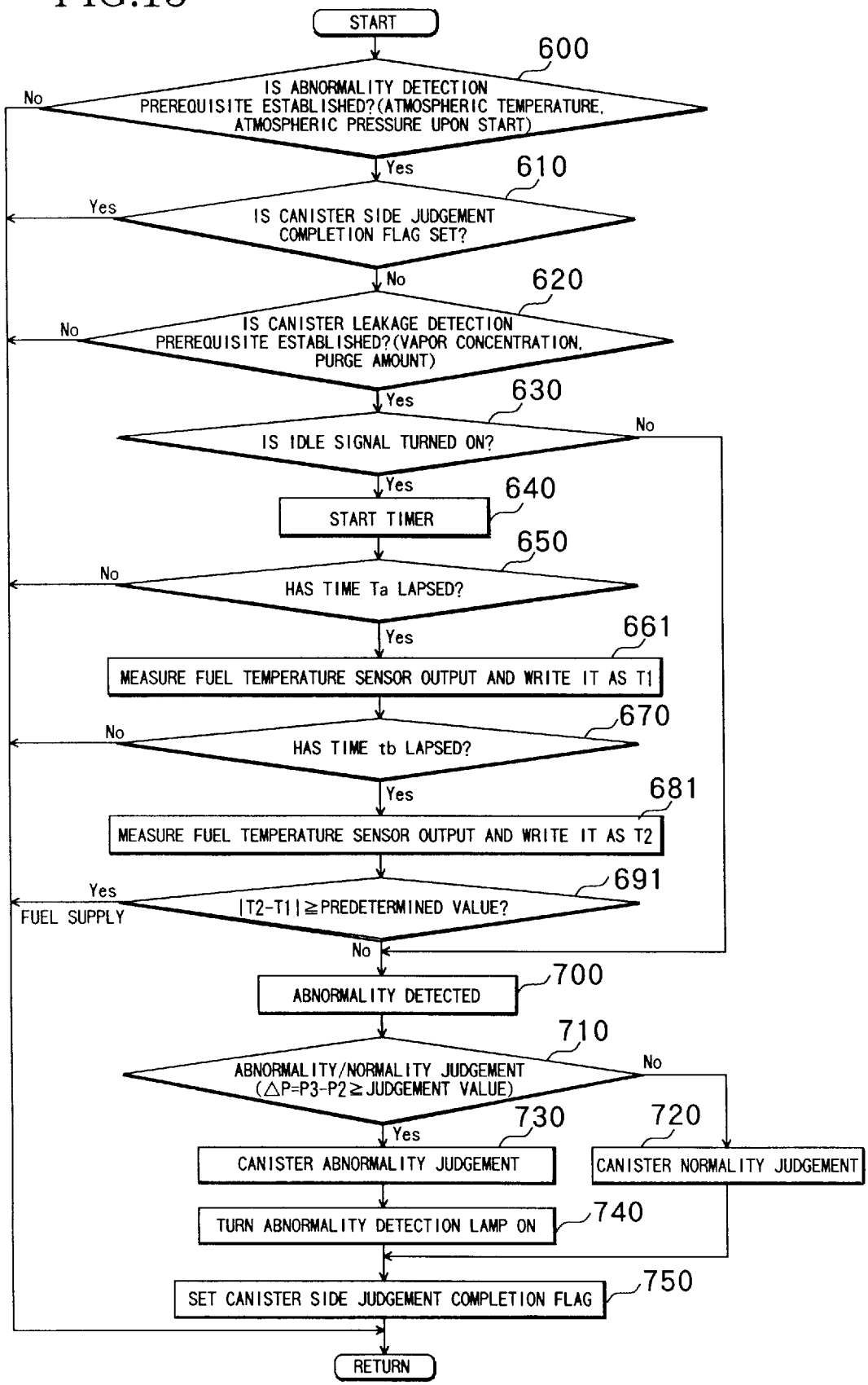
FIG. 13 is a flowchart showing a routine of the failure diagnosing process on a canister side in accordance with a third embodiment in a failure diagnosing apparatus for an evapopurge system according to the present invention.

A failure diagnosing apparatus for an evapopurge system according to a third embodiment of the invention will now be described with reference to FIG. 13.

The overall structure of the evaporated fuel processing apparatus 1 is the same as that of the first embodiment, and therefore, the description thereof will be omitted. The explanation will be made as to a process routine of the failure diagnosing.

In the second embodiment, the increasing/decreasing rate of the fuel amount is detected on the basis of the output signal of the fuel gauge 73 to thereby make a judgement as to whether or not the condition is in the fuel supply. However, in the third embodiment, the increasing/decreasing rate of the fuel amount is detected on the basis of the output signal of the fuel temperature sensor 74 to thereby make a judgement as to whether or not the condition is in the fuel supply.

In the normal operation, the change of the fuel temperature within the fuel reservoir 20 is extremely moderated. However in the fuel supply, the fuel temperature within the fuel reservoir 20 is rapidly changed due to the affect of the temperature of fed fuel. It is determined by the fuel temperature within the fuel reservoir 20 before the fuel supply and the temperature of fed fuel whether the fuel temperature is elevated or lowered. In the third embodiment, by utilizing this phenomenon, it is possible to judge whether or not the condition is in the fuel supply.

In this third embodiment, the judgement means upon the fuel supply is realized by the ECU 90 and the fuel temperature sensor 74.

(Canister Side Failure Diagnosing Process)

The failure diagnosing process for the system on the canister side will be described with reference to FIG. 13.

The explanation for steps 600 to 650 will be omitted because these steps are the same as those of the second embodiment.

In the third embodiment, in the case where it is judged in step 650 that time ta has lapsed from the timer start, the output of the temperature sensor 74 at this time is written as T1 in the RAM of the ECU 90 (step 661). The program is advanced to step 670.

When it is judged in step 670 that time tb has lapsed from the timer start, the output of the temperature sensor 74 at this time is written as T2 in the RAM of the ECU 90 (step 681).

Subsequently, the program is advanced to step 691. T1 and T2 are read out from the RAM of the ECU 90. T2-T1 is calculated. It is judged whether or not its absolute value is not smaller than a predetermined value. In the case where the absolute value of T2-T1 is not smaller than the predetermined value (in the case where it is judged YES in step 691), it is judged that the condition is in the fuel supply. The program is advanced to the return without advancing to the abnormality detection steps from step 700 onward.

In the case where the absolute value of T2-T1 is smaller than the predetermined value (in the case where it is judged NO in step 691), it is judged that the condition is out of the fuel supply. The program is advanced to step 700 and the failure diagnosing process is continued.

Since steps 700 to 750 are the same as those of the second embodiment, their explanation will be omitted.

Incidentally, this failure diagnosing process on the reservoir side is the same as the failure diagnosing process on the reservoir side according to the second embodiment, except that the fuel temperature is detected by the fuel temperature sensor 74 instead of the detection of the fuel amount by the fuel gauge 73 and it is judged, on the basis of the increasing/decreasing rate of the fuel temperature whether or not the fuel supply is performed. Accordingly, its explanation will be omitted.

As described above, also according to the third embodiment, in the same way as in the first or second embodiment, it is possible to prevent the failure diagnosing apparatus from misdiagnosing the evapopurge system during the fuel supply in advance.

Embodiment 4

Figure 14:
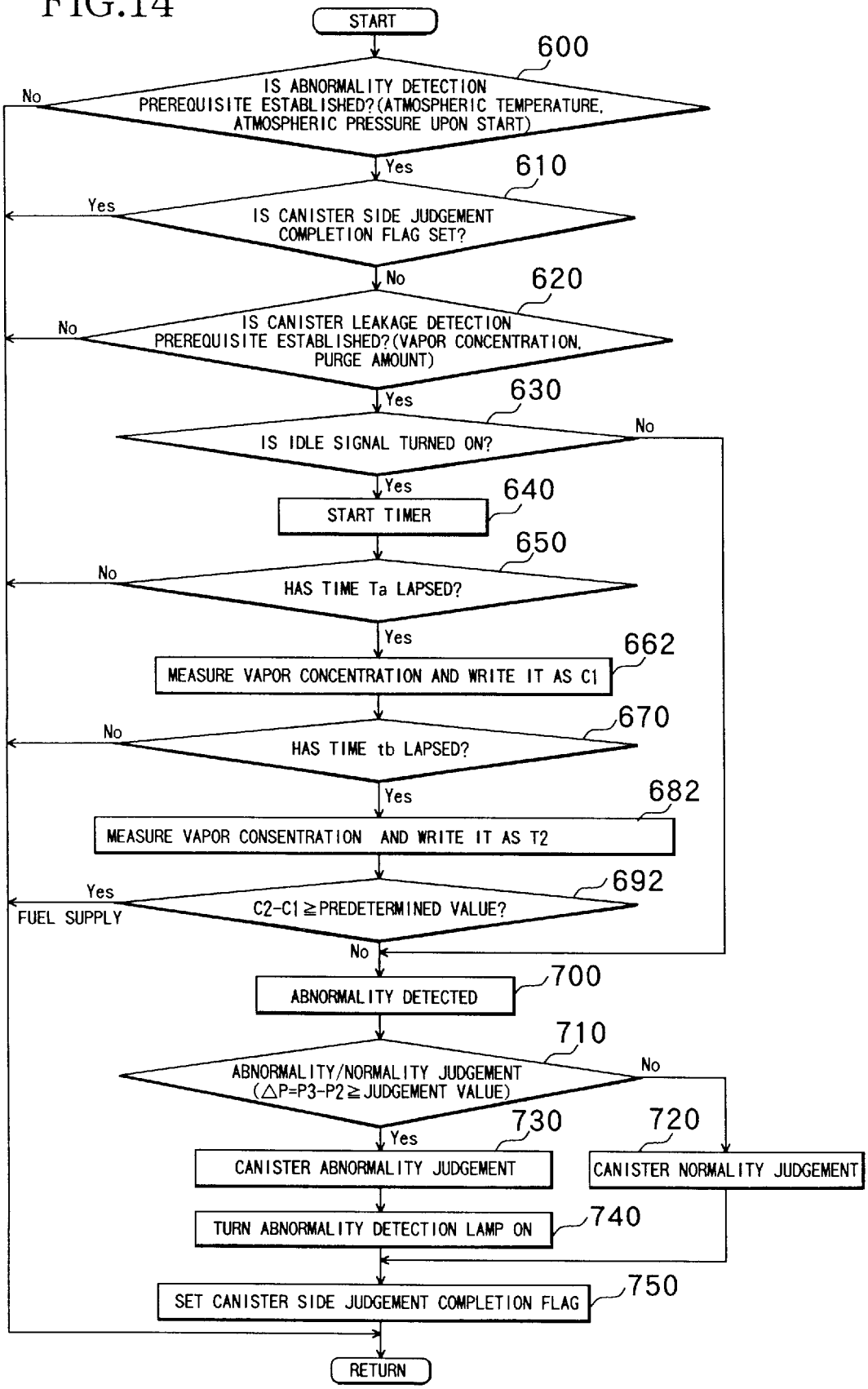
FIG. 14 is a flowchart showing a routine of the failure diagnosing process on a canister side in accordance with a fourth embodiment in a failure diagnosing apparatus for an evapopurge system according to the present invention.

A failure diagnosing apparatus for an evapopurge system according to a fourth embodiment of the invention will now be described with reference to FIG. 14.

The overall structure of the evaporated fuel processing apparatus 1 is the same as that of the first embodiment, and therefore, the description thereof will be omitted. The explanation will be made as to the process routine of the failure diagnosing.

In the second embodiment described above, the increasing/decreasing rate of the fuel amount is detected on the basis of the output signal of the fuel gauge 73 to thereby make a judgement as to whether or not the condition is in the fuel supply. However, in the fourth embodiment, the increasing/decreasing rate of the purge vapor concentration is detected on the basis of the output signal of the purge vapor concentration sensor 82 to thereby make a judgement as to whether or not the condition is in the fuel supply.

Since the large amount of vapor is generated from the supplied fuel during the fuel supply operation and the vapor is discharged to the canister 10 through the breezer line 61, the vapor concentration within the purge line 63 is more rapidly increased than the case where the fuel is not supplied. According to the fourth embodiment, the change rate of the vapor concentration within the purge line 63 and it is judged, on the basis of this result, whether or not the fuel is supplied.

According to the fourth embodiment, the judgement means upon the fuel supply is realized by the ECU 90 and the purge vapor concentration sensor 82.

(Canister Side Failure Diagnosing Process)

The failure diagnosing process for the system on the canister side will be described with reference to FIG. 14.

The explanation for steps 600 to 650 will be omitted because these steps are the same as those of the second embodiment.

In the fourth embodiment, in the case where it is judged in step 650 that time ta has lapsed from the timer start, the output of the purge vapor concentration sensor 82 at this time is written as C1 in the RAM of the ECU 90 (step 662). The program is advanced to step 670.

When it is judged in step 670 that time tb has lapsed from the timer start, the output of the purge vapor concentration sensor 82 at this time is written as C2 in the RAM of the ECU 90 (step 682).

Subsequently, the program is advanced to step 692. C1 and C2 are read out from the RAM of the ECU 90. C2-C1 is calculated. It is judged whether or not its value is not smaller than a predetermined value. In the case where the value of C2-C1 is not smaller than the predetermined value (in the case where it is judged YES in step 692), it is judged that the condition is in the fuel supply. The program is advanced to the return without advancing to the abnormality detection steps from step 700 onward.

In the case where the value of C2-C1 is smaller than the predetermined value (in the case where it is judged NO in step 692), it is judged that the condition is out of the fuel supply. The program is advanced to step 700 and the failure diagnosing process is continued.

Since steps 700 to 750 are the same as those of the second embodiment, their explanation will be omitted.

Incidentally, this failure diagnosing process on the reservoir side is the same as the failure diagnosing process on the reservoir side according to the second embodiment, except that the purge vapor concentration is detected by the purge vapor concentration sensor 82 instead of the detection of the fuel amount by the fuel gauge 73 and it is judged, on the basis of the increasing/decreasing rate of the purge vapor concentration whether or not the fuel supply is performed. Accordingly, its explanation will be omitted.

As described above, also according to the fourth embodiment, in the same way as in the first through third embodiments, it is possible to prevent the failure diagnosing apparatus from misdiagnosing the evapopurge system during the fuel supply in advance.

Embodiment 5

Figure 15:
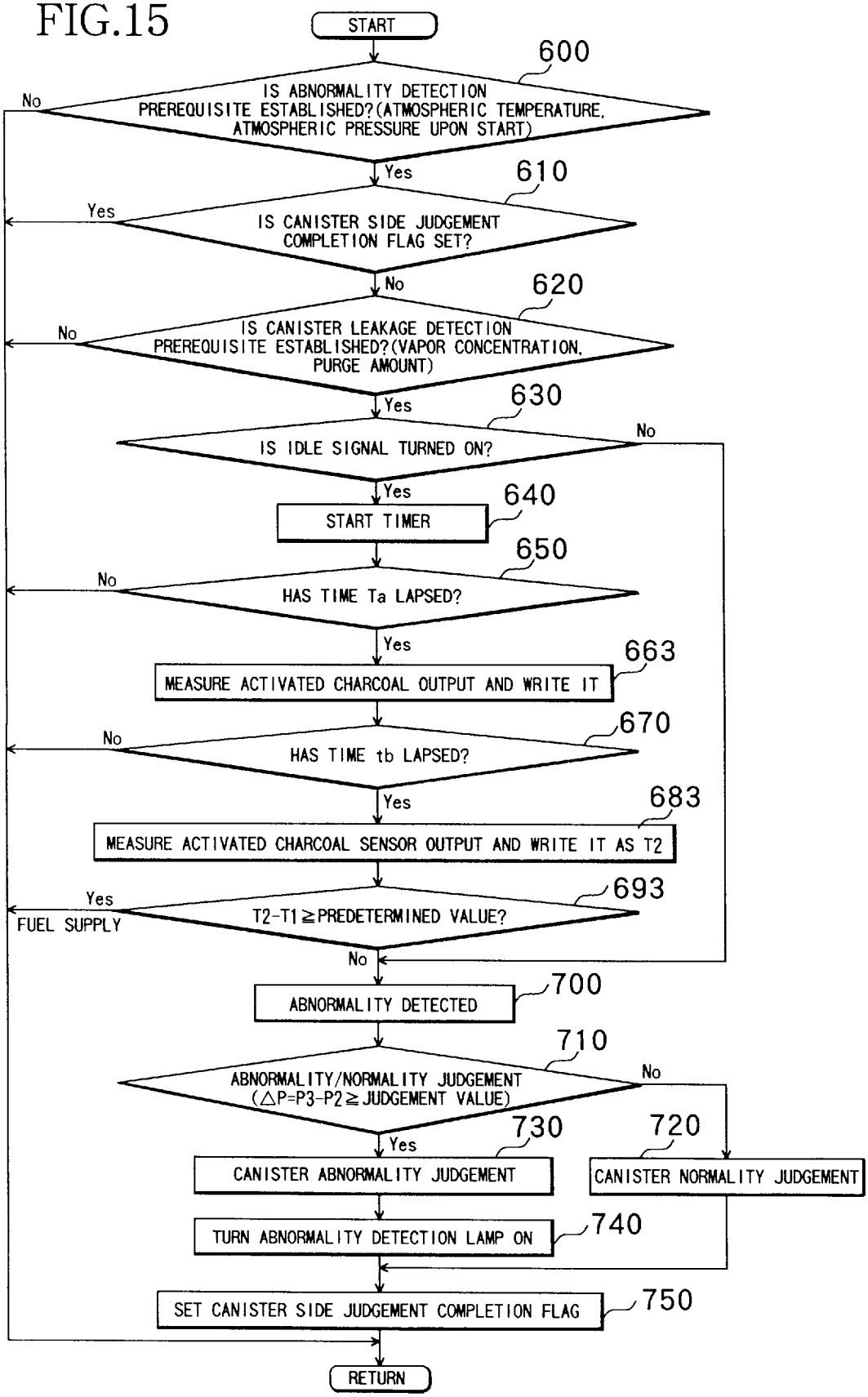
FIG. 15 is a flowchart showing a routine of the failure diagnosing process on a canister side in accordance with a fifth embodiment in a failure diagnosing apparatus for an evapopurge system according to the present invention.

A failure diagnosing apparatus for an evapopurge system according to a fifth embodiment of the invention will now be described with reference to FIG. 15.

The overall structure of the evaporated fuel processing apparatus 1 is the same as that of the first embodiment, and therefore, the description thereof will be omitted. The explanation will be made as to the process routine of the failure diagnosing.

In the second embodiment described above, the increasing/decreasing rate of the fuel amount is detected on the basis of the output signal of the fuel gauge 73 to thereby make a judgement as to whether or not the condition is in the fuel supply. However, in the fifth embodiment, the increasing/decreasing rate of the elevating rate of the temperature of the activated charcoal 11 within the canister 10 is detected on the basis of the output signal of the activated charcoal sensor 14 to thereby make a judgement as to whether or not the condition is in the fuel supply.

Since the large amount of vapor is generated from the supplied fuel during the fuel supply operation and the vapor is discharged to the canister 10 through the breezer line 61, the temperature of the activated charcoal 11 within the canister 10 is more rapidly increased than the case where the fuel is not supplied. According to the fifth embodiment, the temperature elevation of the activated charcoal 11 is detected and it is judged on the basis of this result whether or not the fuel is supplied.

According to the fifth embodiment, the judgement means upon the fuel supply is realized by the ECU 90 and the activated charcoal sensor 14.

(Canister Side Failure Diagnosing Process)

The failure diagnosing process for the system on the canister side will be described with reference to FIG. 15.

The explanation for steps 600 to 650 will be omitted because these steps are the same as those of the second embodiment.

In the fifth embodiment, in the case where it is judged in step 650 that time ta has lapsed from the timer start, the output of the activated charcoal temperature sensor 14 at this time is written as T1 in the RAM of the ECU 90 (step 663). The program is advanced to step 670.

When it is judged in step 670 that time tb has lapsed from the timer start, the output of the activated charcoal temperature sensor 14 at this time is written as T2 in the RAM of the ECU 90 (step 683).

Subsequently, the program is advanced to step 693. T1 and T2 are read out from the RAM of the ECU 90. T2-T1 is calculated. It is judged whether or not its value is not smaller than a predetermined value. In the case where the value of T2-T1 is not smaller than the predetermined value (in the case where it is judged YES in step 693), it is judged that the condition is in the fuel supply. The program is advanced to the return without advancing to the abnormality detection steps from step 700 onward.

In the case where the value of T2-T1 is smaller than the predetermined value (in the case where it is judged NO in step 693), it is judged that the condition is out of the fuel supply. The program is advanced to step 700 and the failure diagnosing process is continued.

Since steps 700 to 750 are the same as those of the second embodiment, their explanation will be omitted.

Incidentally, this failure diagnosing process on the reservoir side is the same as the failure diagnosing process on the reservoir side according to the second embodiment, except that the purge vapor concentration is detected by the activated charcoal temperature sensor 14 instead of the detection of the fuel amount by the fuel gauge 73 and it is judged, on the basis of the elevation of the temperature of the activated charcoal whether or not the fuel supply is performed. Accordingly, its explanation will be omitted.

As described above, also according to the fifth embodiment, in the same way as in the first through fourth embodiments, it is possible to prevent the failure diagnosing apparatus from misdiagnosing the evapopurge system during the fuel supply in advance.

Embodiment 6

Figure 16:
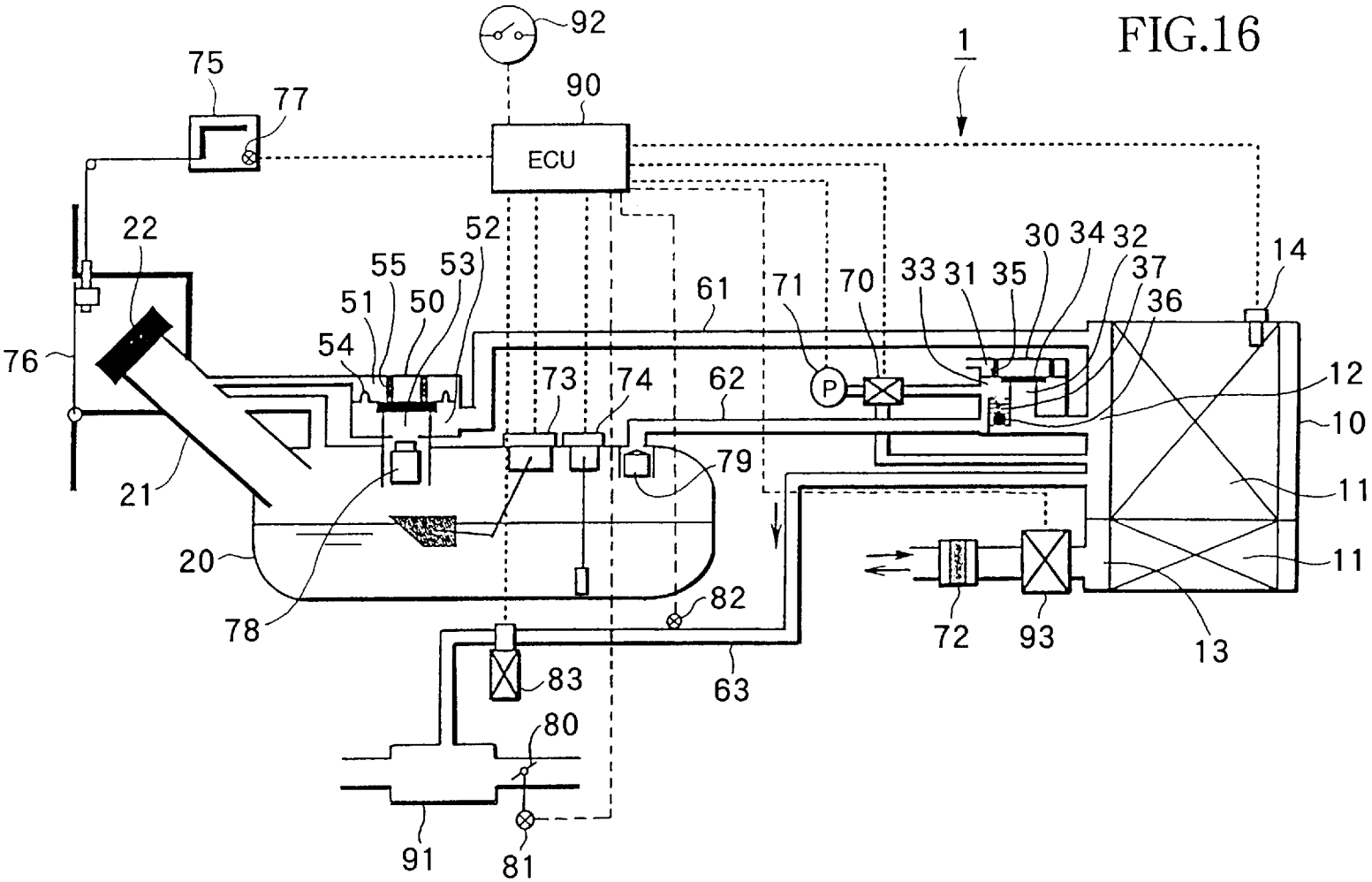
FIG. 16 is a structural view showing an evaporated fuel processing apparatus according to a sixth embodiment in a failure diagnosing apparatus for an evapopurge system according to the invention.

A failure diagnosing apparatus for an evapopurge system according to a sixth embodiment of the invention will now be described with reference to FIG. 16.

The difference between the first through fifth embodiments and the sixth embodiment resides in the structure of the evaporated fuel processing apparatus 1.

In the evaporated fuel processing apparatus 1 according to the sixth embodiment, an electromagnetic opening/closing valve 93 that may be used instead of the atmospheric introducing/discharging valve 40 is used in the diffusing chamber 13 on the atmospheric side of the canister 10. The electromagnetic opening/closing valve 93 is controlled by the ECU 90 so that it is normally opened but closed only upon performing the failure diagnosing process. The other structure is the same as that of the evaporated fuel processing apparatus 1 according to the first embodiment.

In case of the evaporated fuel processing apparatus 1 in the first through fifth embodiments, it is possible to discharge the atmospheric air from the canister 10 in the operational principle of the atmospheric air introduction/discharge valve 40 due to the pressure difference between the atmospheric pressure and the internal pressure within the canister 10 even in the failure diagnosing process or it is possible to introduce the atmospheric pressure into the canister 10. In the first through fifth embodiments, it is possible to perform the failure diagnosing process even in the fuel supply but the diagnosing process is forbidden since there is a fear of misdiagnosing.

In contrast, in case of the sixth embodiment, since the electromagnetic opening/closing valve 93 is fully closed when the failure diagnosing process is performed, when the fuel is supplied in this condition, there is not only a fear that there is misdiagnosis but also it is impossible to discharge the gas due to the fuel supply and there is a fear that the fuel supply to the fuel reservoir 20 would be difficult. For this reason, it is necessary to prohibit the failure diagnosing process during the fuel supply.

It is possible to apply the failure diagnosing forbidding system according to the first through fifth embodiments to the evaporated fuel processing apparatus 1 according to the sixth embodiment. Incidentally, the process routine for forbidding the failure diagnosis is the same as that of the above-described first through fifth embodiments. Accordingly, the explanation therefor will be omitted.

Embodiment 7

In the first through sixth embodiments, the failure diagnosing process is performed separately for the reservoir side and the canister side. It is possible to apply the invention to the evaporated fuel processing apparatus that may simultaneously perform the failure diagnosis for the system on the reservoir side and the system on the canister side.

Various details of the invention may be changed without departing from its spirit nor its scope. Furthermore, the foregoing description of the embodiments according to the present invention is provided for the purpose of illustration only, and not for the purpose of limiting the invention as defined by the appended claims and their equivalents.

What we claim is:

1. A failure diagnosing apparatus for an evapopurge system, comprising:

an evaporated fuel processing apparatus for adsorbing fuel evaporated within a fuel reservoir by an adsorbent and for purging the evaporated fuel, adsorbed by the adsorbent, to an intake system of an internal combustion engine at any time as desired:

a failure judgement means for judging absence/presence of a failure of the evaporated fuel processing apparatus;

an internal combustion engine operation judging means for judging whether or not the internal combustion engine is in operation;

a judgement means upon fuel supply for judging whether or not the fuel is supplied to the fuel reservoir; and a failure judgement forbidding means for forbidding the failure judgement by said failure judgement means when it is judged by said internal combustion engine operation judging means and said judgement means upon fuel supply that the internal combustion engine is in operation and the fuel is supplied.

2. The failure diagnosing apparatus according to claim 1, wherein said judgement means upon fuel supply comprises an opening condition detecting means for detecting an opening condition of a fuel supply inlet of the fuel reservoir;

wherein it is judged that the fuel is supplied to the fuel reservoir when it is judged by said opening condition detecting means that the fuel supply inlet is under the open condition.

3. The failure diagnosing apparatus according to claim 1, wherein said judgement means upon fuel supply comprises a fuel amount detecting means for detecting increasing/decreasing of the fuel amount within the fuel reservoir;

wherein it is judged that the fuel is supplied to the fuel reservoir when it is judged by said fuel amount detecting means that the fuel amount is increased.

4. The failure diagnosing apparatus according to claim 1, wherein said judgement means upon fuel supply comprises a fuel temperature detecting means for detecting a temperature of the fuel within the fuel reservoir;

wherein it is judged that the fuel is supplied to the fuel reservoir when it is judged that a change rate per a unit time of the fuel temperature detected by said fuel temperature detecting means is not smaller than a predetermined value.

5. The failure diagnosing apparatus according to claim 1, wherein said judgement means upon fuel supply comprises an evaporated fuel concentration detecting means for detecting a concentration of the evaporated fuel passing through at least one of an evaporated fuel passage for communicating the fuel reservoir and the adsorbent and an evaporated fuel passage for communicating the adsorbent and the intake system;

wherein it is judged that the fuel is supplied to the fuel reservoir when it is judged that a change rate per a unit time of the evaporated fuel concentration detected by said evaporated fuel concentration detecting means is not smaller than a predetermined value.

6. The failure diagnosing apparatus according to claim 1, wherein said judgement means upon fuel supply comprises an adsorbent temperature detecting means for detecting a temperature of the adsorbent;

wherein it is judged that the fuel is supplied to the fuel reservoir when it is judged that a change rate per a unit time of the adsorbent temperature detected by said adsorbent temperature detecting means is not smaller than a predetermined value.

7. The failure diagnosing apparatus according to claim 1, wherein said internal combustion engine operation judging means judges that the internal combustion engine is in operation, when the internal combustion engine is in operation and a vehicle which provides with the internal combustion engine is in stopping condition.

8. The failure diagnosing apparatus according to claim 1, wherein said internal combustion engine operation judging means judges that the internal combustion engine is in operation, when the internal combustion engine is under the idle condition.

* * * * *

UNITED STATES PATENT AND TRADEMARK OFFICE

CERTIFICATE OF CORRECTION

PATENT NO. : 5,873,352

DATED : 23 February 1999

INVENTOR(S) : Toru KIDOKORO et al.

It is certified that error appears in the above-identified patent and that said Letters Patent is hereby corrected as shown below:

In the Abstract, line 1: Change "an" to --a--.

| Column | Line | |
|---|---|---|
| 1 | 16 | Change "engine" to --engines--. |
| 1 | 28 | Change "engines" to --engine--. |
| 4 | 34 | Change "a evaporated" to --an evaporated--. |
| 4 | 42 | After "engine" delete "**91**". |
| 6 | 4 | Change "is" to --are--. |
| 7 | 6 | After "provided" insert --with--. |
| 9 | 18 | Change "judge" to --judged--. |
| 9 | 33 | Change "judge" to --judged--. |
| 9 | 56 | Change "a abnormal to --an abnormal--. |
| 9 | 60 | Change "grater" to --greater--. |
| 10 | 29 | Change "lapsed" to --elapsed--. |
| 11 | 35 | Change "o make" to --to make--. |
| 12 | 1 | Change "judge" to --judged--. |
| 12 | 9 | After "fear of " delete "the". |
| 12 | 18 | Change "According" to --Accordingly--. |

UNITED STATES PATENT AND TRADEMARK OFFICE

CERTIFICATE OF CORRECTION

PATENT NO. : 5,873,352

DATED : 23 February 1999

INVENTOR(S) : Toru KIDOKORO et al.

It is certified that error appears in the above-identified patent and that said Letters Patent is hereby corrected as shown below:

| Column | Line | |
|---|---|---|
| 12 | 37 | Change "lapsed" to --elapsed--. |
| 12 | 38 | Change "lapsed" to --elapsed--. |
| 12 | 42 | Change "lapsed" to --elapsed--. |
| 12 | 43 | Change "lapsed" to --elapsed--. |
| 12 | 47 | Change "lapsed" to --elapsed--. |
| 12 | 48 | Change "lapsed" to --elapsed--. |
| 12 | 66 | Change "lapsed" to --elapsed--. |
| 14 | 35 | Change "lapsed" to --elapsed--. |
| 14 | 36 | Change "lapsed" to --elapsed--. |
| 14 | 38 | Change "lapsed" to --elapsed--. |
| 14 | 65 | Change "lapsed" to --elapsed--. |
| 14 | 66 | Change "lapsed" to --elapsed--. |
| 15 | 28 | Change "affect" to --effect--. |
| 15 | 45 | Change "lapsed" to --elapsed--. |
| 15 | 49 | Change "lapsed" to --elapsed--. |
| 16 | 58 | Change "lapsed" to --elapsed--. |

UNITED STATES PATENT AND TRADEMARK OFFICE

CERTIFICATE OF CORRECTION

PATENT NO. : 5,873,352

DATED : 23 February 1999

INVENTOR(S) : Toru KIDOKORO et al.

It is certified that error appears in the above-identified patent and that said Letters Patent is hereby corrected as shown below:

| Column | Line | |
|---|---|---|
| 18 | 1 | Change "lapsed" to --elapsed--. |
| 19 | 37 | Change "desired:" to --desired;--. |
| 20 | 47 | Change "provides" to --is provided--. |

Signed and Sealed this

Sixth Day of June, 2000

*Attest:*

*Attesting Officer*

Q. TODD DICKINSON

*Director of Patents and Trademarks*